US005685222A

United States Patent [19]

Yokoyama et al.

[11] Patent Number: 5,685,222

[45] Date of Patent: Nov. 11, 1997

[54] CONTROL DEVICE FOR A THERMOSENSITIVE STENCIL PRINTER

[75] Inventors: Yasumitsu Yokoyama; Yoshiyuki Shishido; Satoshi Katoh, all of Kakuda, Japan

[73] Assignee: Tohoku Ricoh Co., Ltd., Miyagi-ken, Japan

[21] Appl. No.: 398,943

[22] Filed: Mar. 2, 1995

[30] Foreign Application Priority Data

Mar. 2, 1994 [JP] Japan ..... 6-032195
Mar. 2, 1994 [JP] Japan ..... 6-032196

[51] Int. Cl.[6] ..... B41J 2/36

[52] U.S. Cl. ..... 101/128.4; 400/120.13; 347/188; 347/193

[58] Field of Search ..... 101/128.21, 128.4; 347/188, 192, 193, 196; 400/120.09, 120.12, 120.13

[56] References Cited

U.S. PATENT DOCUMENTS

| | | | |
|---|---|---|---|
| 4,983,994 | 1/1991 | Mori et al. | 347/193 |
| 5,025,267 | 6/1991 | Schofield et al. | 347/196 |
| 5,195,832 | 3/1993 | Fujikawa et al. | 101/128.21 |
| 5,216,951 | 6/1993 | Yokoyama et al. | 101/128.4 |
| 5,355,793 | 10/1994 | Sato et al. | 101/128.21 |
| 5,417,156 | 5/1995 | Tateishi et al. | 101/128.4 |
| 5,432,533 | 7/1995 | Shibamiya | 347/192 |
| 5,491,503 | 2/1996 | Fuwa | 101/128.4 |

FOREIGN PATENT DOCUMENTS

| | | |
|---|---|---|
| 0 572 193 | 1/1993 | European Pat. Off. . |
| 1-238370 | 9/1989 | Japan . |
| 1-238955 | 9/1989 | Japan . |
| 1-238956 | 9/1989 | Japan . |
| 2-67133 | 3/1990 | Japan . |
| 4-71847 | 3/1992 | Japan . |
| 4-265759 | 9/1992 | Japan . |

*Primary Examiner*—Stephen R. Funk
*Attorney, Agent, or Firm*—Oblon, Spivak, McClelland, Maier & Neustadt, P.C.

[57] ABSTRACT

A control device for a thermosensitive stencil printer which is capable of perforating a stencil in an optimal configuration matching a desired resolution in the subscanning direction and thereby producing desirable images. The device allows perforations to be formed in a stencil in an adequate size in the subscanning direction. Heating portions included in a thermal head are each sized, in the subscanning direction, smaller than a feed pitch corresponding to the highest resolution available with a resolution setting device.

9 Claims, 20 Drawing Sheets

25
DIGITAL IMAGE SIGNAL
DECODER
POWER SOURCE
26
IMAGE DATA SIGNAL
30
HEAD DRIVER
DRIVE SIGNAL
27
HEAD
THERMISTOR
35
41
40
92
MASTER FEED MOTOR DRIVER
MASTER FEED MOTOR
PLATEN ROLLER
83B
83A
82a,83a
DOCUMENT CONVEYOR ROLLER MOTOR DRIVER
DOCUMENT CONVEYOR ROLLER MOTOR
CONVEYOR ROLLER

MAIN SCAN RESOLUTION OF 300dpi
SUBSCAN RESOLUTION OF 300dpi

MAIN SCAN RESOLUTION OF 300dpi
SUBSCAN RESOLUTION OF 400dpi

CONTROL DEVICE FOR A THERMOSENSITIVE STENCIL PRINTER

BACKGROUND OF THE INVENTION

The present invention relates to a control device for a thermosensitive stencil printer and capable of perforating a stencil in an optimal configuration matching a resolution in the subscanning direction and thereby insuring desirable image quality.

Generally, a stencil printer perforates a thermosensitive stencil in a pattern matching a desired image, wraps the perforated stencil or master around a print drum, feeds ink from the inner periphery of the drum to the rear of the master, and forms an ink image on a sheet by the ink passed through the perforation pattern of the master. This kind of printer includes a thermal head having an array of heating portions arranged in the main scanning direction. The heating portions are energized at a constant line period so as to transform electric energy to thermal energy, i.e., generate Joule heat, thereby perforating the stencil. It is to be noted that the line period, or printing period, refers to the interval between the consecutive times when the heating element of each heating portion is energized.

The problem with the stencil printer is that when printings produced thereby are sequentially stacked on a tray, the ink is transferred from the front of the underlying printing to the rear of the overlying printing and smears the latter. To eliminate this problem, perforations which are discrete in both the main scanning direction and the subscanning direction may be formed in the stencil so as to reduce the transfer of the ink, as taught in Japanese Patent Laid-Open Publication Nos. 2-67133, 4-71847, and 4-265759 by way of example.

Although the prior art discrete perforation scheme obviates smears due to the undesirable ink transfer, it has the following problem left unsolved. Assume that the resolution in the subscanning direction is increased while the line period is maintained the same. Then, perforations formed in the stencil are joined together in the subscanning direction. Hence, with the conventional scheme, it is not practicable to increase the resolution in the subscanning direction or to meet the increasing demand for higher image quality.

SUMMARY OF THE INVENTION

It is, therefore, an object of the present invention to provide a control device for a thermosensitive stencil printer and capable of perforating a stencil in an optimal configuration matching a resolution in the subscanning direction and thereby insuring desirable image quality.

In accordance with the present invention, in a thermosensitive stencil printer which presses a thermal head having an array of heating portions arranged in the main scanning direction against a thermosensitive stencil, causes, while causing stencil conveying members to convey the stencil in the subscanning direction perpendicular to the main scanning direction, the heating portions to selectively generate heat in accordance with an image signal to thereby perforate the stencil in a pattern matching the image signal, wraps the perforated stencil around a print drum, feeds ink from the inner periphery of the print drum to a sheet via the pattern of the stencil to thereby form an ink image on the sheet, a control device has a driver for driving the stencil conveying members such that the stencil moves at a predetermined pitch, a resolution setting member for setting a desired resolution in the subscanning direction, a drive controller for controlling, in response to the output of the resolution setting member, the driver to set up a particular feed pitch matching the desired resolution, and a heating interval controller for increasing, when the desired resolution indicated by the output of the resolution setting member is high, an interval between the consecutive times when each of the heating portions generates heat. The heating portions each have a dimension in the subscanning direction which is smaller than the feed pitch matching the highest resolution available with the resolution setting member.

Also, in accordance with the present invention, in a thermosensitive stencil printer of the type described, a control device has a driver for driving the stencil conveying members such that the stencil moves at a predetermined pitch, a resolution setting member for setting a desired resolution in the subscanning direction, a drive controller for controlling, in response to the output of the resolution setting member, the driver to set up a particular feed pitch matching the desired resolution, and an energy controller for controlling, in response to the output of the resolution setting member, energy to be applied to the heating portions to a predetermined energy. The heating portions each have a dimension in the subscanning direction which is smaller than the feed pitch matching the highest resolution available with the resolution setting member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
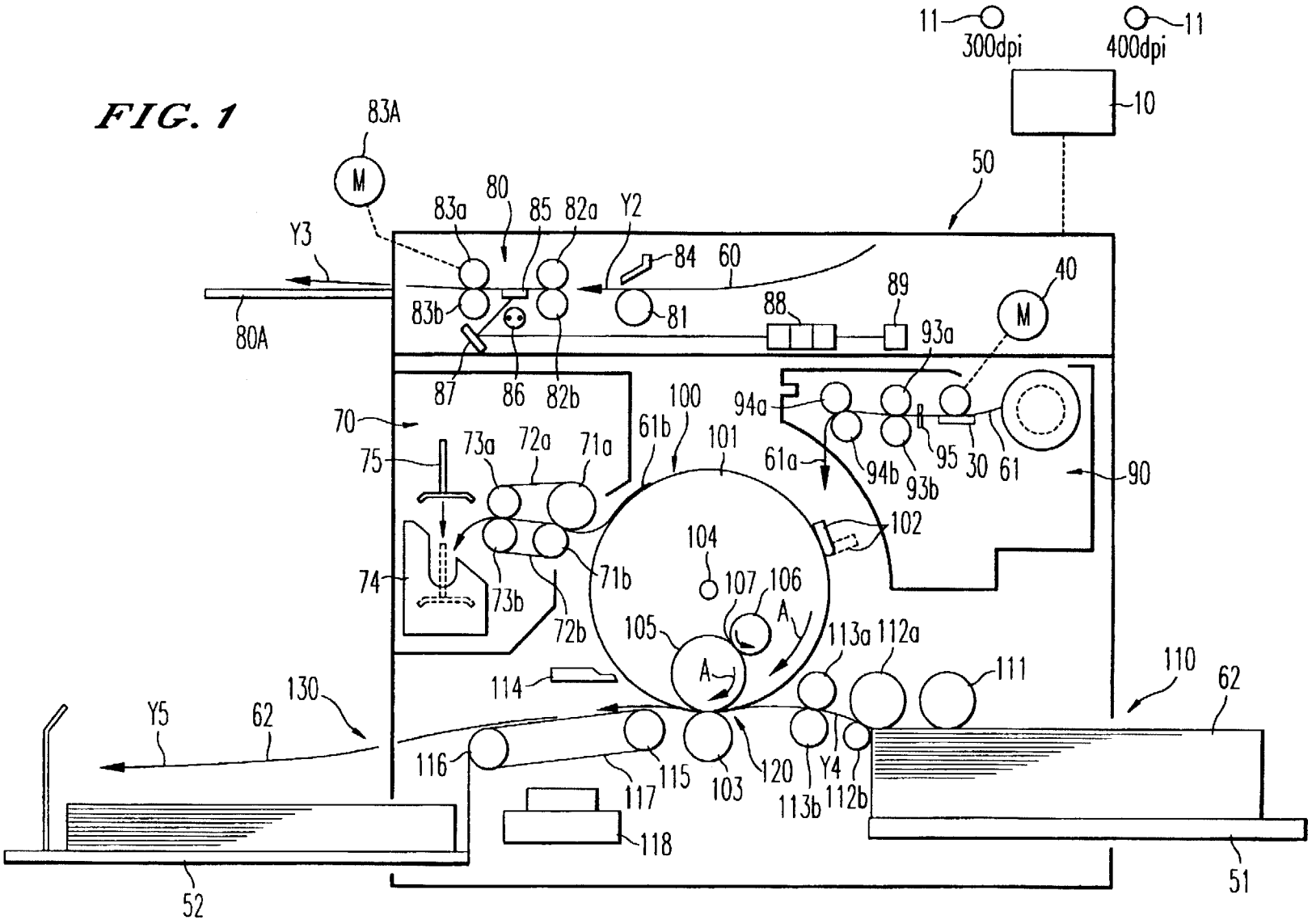
FIG. 1 is a section of a thermosensitive stencil printer to which the present invention is applied.

Referring to FIG. 1 of the drawings, a thermosensitive stencil printer to which the present invention is applied is shown. As shown, the printer has a housing or cabinet 50. A document reading section 80 is disposed in an upper portion of the housing 50. A master making and feeding section 90 is positioned below the reading section 80 and at the right-hand side, as viewed in the figure. A print drum section 100 is located at the lower center of the housing 50 and includes a porous print drum 101. A master collecting section 70 is disposed at the left of the print drum section 100. A sheet feeding section 110 is provided below the master making and feeding section 90. A pressing section 120 is located below the print drum 101. Further, a sheet discharging section 130 is positioned at the lower left-hand side of the housing 50.

The operation of the printer will be described together with a more specific arrangement of the printer. To begin with, a document 60 carrying a desired image thereon is laid on a document table, not shown, provided on the top of the reading section 80. In this condition, a master start key provided on an operation panel, although not shown in the figure, is pressed to start a master making operation. This operation begins with a master collecting procedure. Specifically, at the time when the start key is pressed, a master **61*b* used last time is still left on the print drum 101. Hence, in the master collecting procedure, the print drum 101 is rotated counterclockwise, as viewed in the figure, carrying the master 61*b* thereon. As the trailing edge of the master 61*b* approaches a pair of separator rollers 71*a* and 71*b*, it is picked up by one separator roller 71*a*. A pair of conveyor belts 72*a* and 71*b* are respectively passed over the separator roller 71*a* and a discharge roller 73*a* and over the separator roller 71*b* and a discharge roller 73*b*. The discharger rollers 73*a* and 73*b* are located at the left of the rollers 71*a* and 71*b* in a pair. The master 61*b* picked up by the roller 71*a* is conveyed by the pair of belts 71*a* and 72*b* in a direction indicated by an arrow Y1 until it has been collected in a box 74. This is the end of the master collecting procedure. At this instant, the print drum 101 is continuously rotated counterclockwise. The master 61*b* collected in the box 74 is compressed within the box 74 by a presser 75**.

In parallel with the master collecting procedure, the reading section 80 reads the document 60. Specifically, the document 60 is sequentially conveyed from the document table in directions Y2 and Y3 by a separator roller 81, a front conveyor roller pair **82*a* and 82*b*, and a rear conveyor roller pair 83*a* and 83*b*, while being read by optics. When a plurality of documents are stacked on the table, only the lowermost document is fed out by being separated from the others by a blade 84. The rear conveyor roller 83*a* is driven by a motor 83A. The front conveyor roller 82*a* is driven via a timing belt, not shown, passed over the conveyor rollers 83*a* and 82*a*. The rollers 82*b* and 83*b* are respectively driven by the rollers 82*a* and 83*a*. As a lamp 86 illuminates the document 60 being conveyed over a glass platen 85, the resulting imagewise reflection from the document 60 is reflected by a mirror 87 and then incident to an image sensor 89 via a lens 88. The image sensor 89 is implemented by CCDs (Charge Coupled Devices). In this way, the document 60 is read by a conventional reduction type scanning system. The document 60 read by the image sensor 89 is driven out to a tray 80A. The image sensor 89 converts the light incident thereto to a corresponding electric signal and sends it to an analog-to-digital converter, not shown, which is disposed in the housing 50**. The ADC transforms the input electric signal to a digital image signal.

Further, in parallel with the reading operation stated above, a master making and feeding procedure is executed on the basis of the digital image signal or image data. A thermosensitive stencil 61 is implemented as a roll and set in a predetermined position inside of the master making and feeding section 90. In the procedure to be described, the leading edge of the stencil 61 is paid out from the roll and passed through between a thermal head 30 and a platen roller, or stencil conveying means, 92. Then, the stencil 61 is driven by a feed roller pair **93*a* and 93*b* and another roller pair 94*a* and 94*b* to the outer periphery of the print drum 101. The head 30 perforates the stencil 61 being conveyed, thereby producing a master 61*a*. Specifically, the head 30 has an array of small heating portions, not shown, arranged in the main scanning direction. The heating portions selectively generate heat in accordance with the digital image signal from the ADC. As a result, a thermoplastic resin film, forming part of the stencil 61, is melted and perforated by the heat in the portions thereof contacting such heating portions. Consequently, the image data representative of the document 60 are formed in the stencil 61 as a perforation pattern, whereby a master 61*a*** is produced.

The leading edge of the master **61*a* is conveyed by the master feed roller pair 94*a* and 94*b* toward the periphery of the print drum 101. Then, the leading edge of the master 61*a* is steered by a guide member, not shown, to move downward or hang toward a master clamper 102. At this instant, the master clamper 102 is located at the illustrated master feed start position and held open, as indicated by a dash-and-dots line in the figure. Also, the master 61*b* used last time has already been removed from the print drum 101 by the previously stated procedure. The leading edge of the master 61*a* is clamped by the master clamper 102 at a predetermined timing. In this condition, the print drum 101, rotating in a direction A (clockwise), causes the master 61*a* to sequentially wrap therearound. A cutter 95 cuts the trailing edge of the master 61*a* at a predetermined length. The master making and feeding procedure ends when the master 61*a* provided with one page of image or a plurality of pages of images is fully wrapped around the print drum 101**.

In the above condition, a printing procedure begins. Sheets 62 are stacked on a sheet feed tray 51. The lowermost one of the sheets 62 is picked up by a pick-up roller 111 and a separation roller pair **112*a* and 112*b* and fed toward a feed roller pair 113*a* and 113*b* in a direction indicated by an arrow Y. The feed roller pair 113*a* and 113*b* drives the sheet 62 to the pressing section 120 at a predetermined timing synchronous to the rotation of the print drum 101. When the sheet 62 arrives at the gap between the print drum 101 and a press roller 103, the roller 103 is raised to press the sheet 62 against the master 61*a* wrapped around the drum 101. As a result, ink is transferred from the porous portion of the print drum 101 to the sheet 62 via the perforation pattern of the master 61*a*, thereby forming an image on the sheet 62**.

Specifically, in the print drum 101, ink is fed from an ink supply tube 104 to an ink well 107 formed between an ink roller 105 and a doctor roller 106. The ink roller 105 is rotated in the same direction as and in synchronism with the print drum 101 while being held in contact with the inner periphery of the drum 101. Hence, the ink roller 105 feeds the ink to the inner periphery of the drum 101. The ink is implemented by a W/O type emulsion ink.

The sheet 62 carrying the image thereon is separated from the print drum 101 by a separator in the form of a blade 114. A conveyor belt 117 is passed over an inlet roller 115 and an outlet roller 116 and rotated counterclockwise. In this condition, the sheet 62 separated from the drum 101 is conveyed by the belt 117 toward the sheet discharging section 130, as indicated by an arrow Y5, while being sucked by a fan 118. In this way, the consecutive sheets, or printings, 62 are sequentially stacked on the tray 52. This completes trial printing.

After the trial printing, the operator enters a desired number of printings on numeral keys, not shown, also arranged on the operation panel and then presses a print start key, not shown. Then, the sheet feeding, printing and sheet discharging steps are repeated in the same order as during trial printing a number of times corresponding to the desired number of printings.

The stencil 61 is 40 μm thick in total and made up of Japanese paper, which is a porous substrate, and a 2 μm thick thermoplastic resin film adhered thereto.

1st Embodiment

A control device embodying the present invention will be described hereinafter. The control device is capable of setting a desired resolution in the subscanning direction, as follows. A resolution key, or resolution setting means, 10 is provided on the operation panel in order to set a desired resolution in the subscanning direction. The resolution key 10, like a fine mode key included in a copier or the like, may be operated by hand to select a desired resolution. In the illustrative embodiment, the key 10 sets up either a resolution of 300 dpi (dots per inch) or a resolution of 400 dpi every time it is pressed. Two LEDs (Light Emitting Diodes) 11 adjoin the resolution key 10 and indicate the resolutions of 300 dpi and 400 dpi, respectively.

A master feed motor 40 is drivably connected to the platen roller 92 by a timing belt, not shown. The motor 40 is implemented by a stepping motor and driven intermittently. Hence, the platen roller 92 conveys the stencil 61 at a predetermined pitch in the subscanning direction perpendicular to the main scanning direction. The thermal head 30 has a resolution of 300 dpi in the main scanning direction. The fine heating portions of the head 30 arranged in the main scanning direction are constituted by rectangular heating elements.

To better understand the control over the energy to be fed to the heating portions of the head 30, the construction and operation of the heating portions will be described specifically. In the printer, the density of a printed image is determined by the amount of ink to be passed through the perforation pattern of the master 61*a*. The amount of such ink is proportional to the area or size of each perforation formed in the master 61*a* and to the fluidity of ink. Hence, when the ink is low in fluidity or hard, the perforations forming a pattern may be increased in size to make up for the decrease in the amount of ink to be passed through the pattern. As a result, an image of desirable density will be printed on a sheet. Conversely, when the ink is high in fluidity or soft, the size of the perforations may be reduced to make up for the increase in the amount of such ink. Stated another way, a desirable image is achievable without regard to the fluidity of the ink if the perforations are formed in a size matching the fluidity. Since the fluidity of the ink depends on the temperature of the ink, perforation energy corresponding to the temperature of each heating portion of the head, i.e., the size of each perforation for achieving an optimal image can be determined in matching relation to the varying ink temperature.

Further, the size of each perforation is proportional to the perforation energy corresponding to the temperature of each heating portion of the head 30. Hence, by controlling the perforation energy corresponding to each heating portion of the head 30, it is possible to determine the size of the perforations which will produce an optimal image.

Figure 3A:
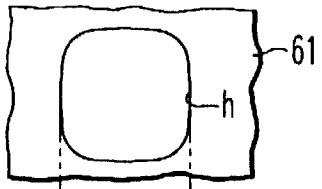
FIGS. 2A–2E and 3A–3D show the structure of a thermal head included in the printer and the perforating operation thereof.
Figure 3B:
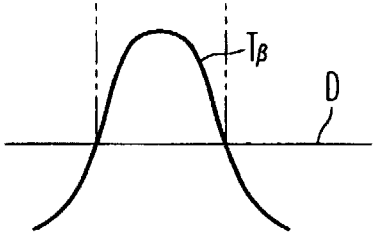
Figure 3C:
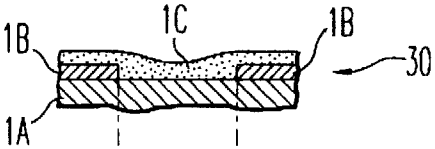
Figure 2A:
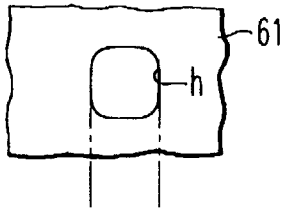
Figure 2B:
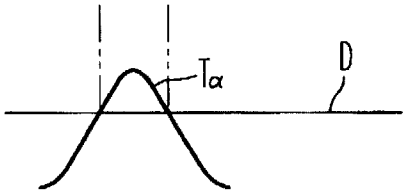
Figure 2C:
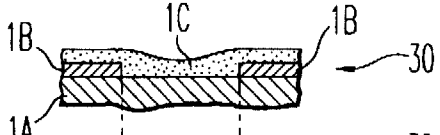
Figure 2D:
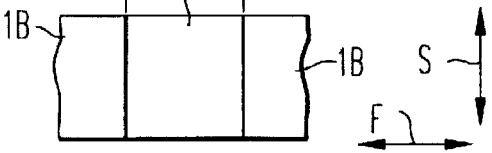

A reference will be made to FIGS. 2A–2E and 3A–3D for describing a relation between the energy to be fed to each heating portion of the head 30, i.e., the temperature of each heating element and the size of the resulting perforation. FIGS. 2C and 3C are sections each showing the structure of the fine heating portion included in the head 30. As shown, the heating portion is made up of a heating element 1A, lead electrodes 1B, and a protection film 1C. The heating element 1A is formed on a substrate (indicated by hatching) and implemented as a thin layer of a material having high electric resistance. When a voltage is applied between the lead electrodes 1B, a current flows through part of the heating element 1A intervening between the lead electrodes 1B. This part of the heating element 1A generates heat due to Joule heat. The head 30 has such fine heating portions arranged at a predetermined pitch in the main scanning direction (perpendicular to the sheet surface of FIGS. 2C and 3C). The stencil 61 is perforated by the head 30 while moving in the subscanning direction, i.e., the right-and-left direction as viewed in FIGS. 2C and 3C.

Figure 3D:
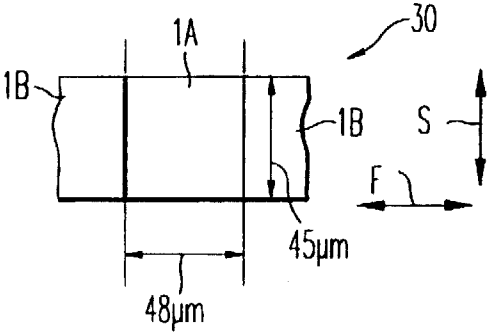

As shown in FIG. 3D, each heating element 1A is sized 45 μm in the main scanning direction S and 48 μm in the subscanning direction F. The dimension in the direction F is selected to be smaller than a feed pitch of 65.5 μm/line corresponding to the higher resolution of 400 dpi which is available with the resolution key 10.

Figure 2E:
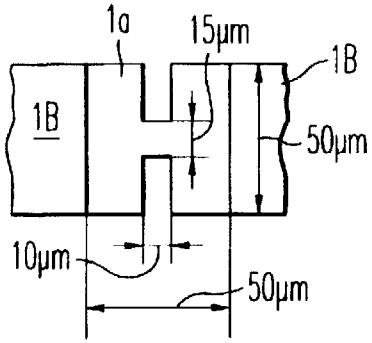

FIG. 2E shows a specific configuration of a heat concentration type heating portion, as distinguished from the rectangular heating portion stated above. As shown, the intermediate portion of the heating element 1A is narrower than the other portions to cause heat to concentrate thereon. The heating element 1A has an overall length of 50 μm in the subscanning direction F and an overall width of 50 μm in the main scanning direction S. The narrower intermediate portion is 10 μm long in the direction F and 15 μm wide in the direction S.

When electric energy for perforation is applied to the heating portion, the heating element 1A transforms it to thermal energy and thereby heats the stencil 61 contacting the protection layer 1C. The resulting temperature distribution is conical, as indicated by a curve Tα in FIG. 2B or a curve Tβ in FIG. 3B. It will be seen that FIGS. 2B and 3B respectively show a case wherein the energy fed to the heating portion is relatively small and a case wherein it is relatively great. In FIGS. 2B and 3C, a line D represents a threshold temperature for the thermoplastic resin film of the stencil 61 to melt. The stencil 61 is formed with a relatively small perforation h shown in FIG. 2A or a relatively great perforation h shown in FIG. 3A, depending on the energy fed to the heating portion. It is, therefore, possible to control the perforation size by controlling the energy to be applied to each heating portion of the head 30. This is true with both the rectangular heating portion and the heat concentration type heating portion. Energy for printing an adequate image can be determined by experiments.

The perforation size depends on the temperature of ink on one hand and on the energy for perforation on the other hand, as stated above. Hence, the ink temperature and perforation energy for producing an adequate image have a certain relation which can be determined by experiments. While the heat generated by the heating portion of the head 30 is mostly consumed in melting and perforating the stencil 61, it is partly transferred to the head 30 and heats it. Although the temperature elevation of the head 30 due to such heat is usually not noticeable, the heat accumulates when the head 30 is continuously operated for a long period of time. The heat accumulated in the head 30 is added to the heat generated by the perforation energy, resulting in a perforation greater in size than an expected perforation.

In the light of the above, the perforation energy is corrected in accordance with the temperature of the head 30 and that of the ink in such a manner as to produce perforations of optimal size. The embodiment corrects the energy by changing the duration or width of pulses to be fed to the heating element 1A, although the current to flow through each heating portion or the voltage to be applied thereto in response to the image signal may be changed.

Figure 4A:
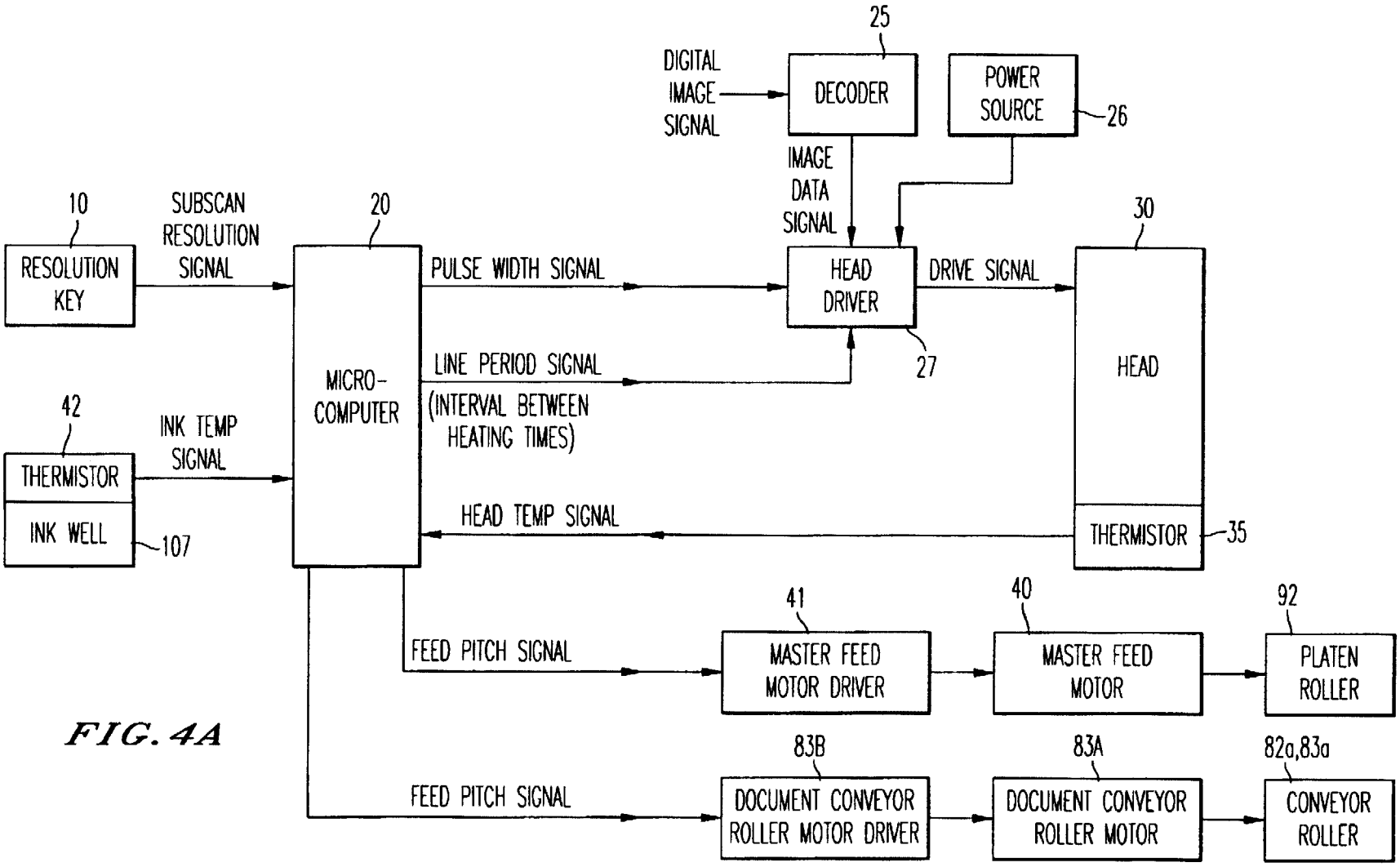
FIG. 4, which consists of FIGS. 4A and 4B, is a block diagram schematically showing a first embodiment of the control device in accordance with the present invention.
Figure 4B:
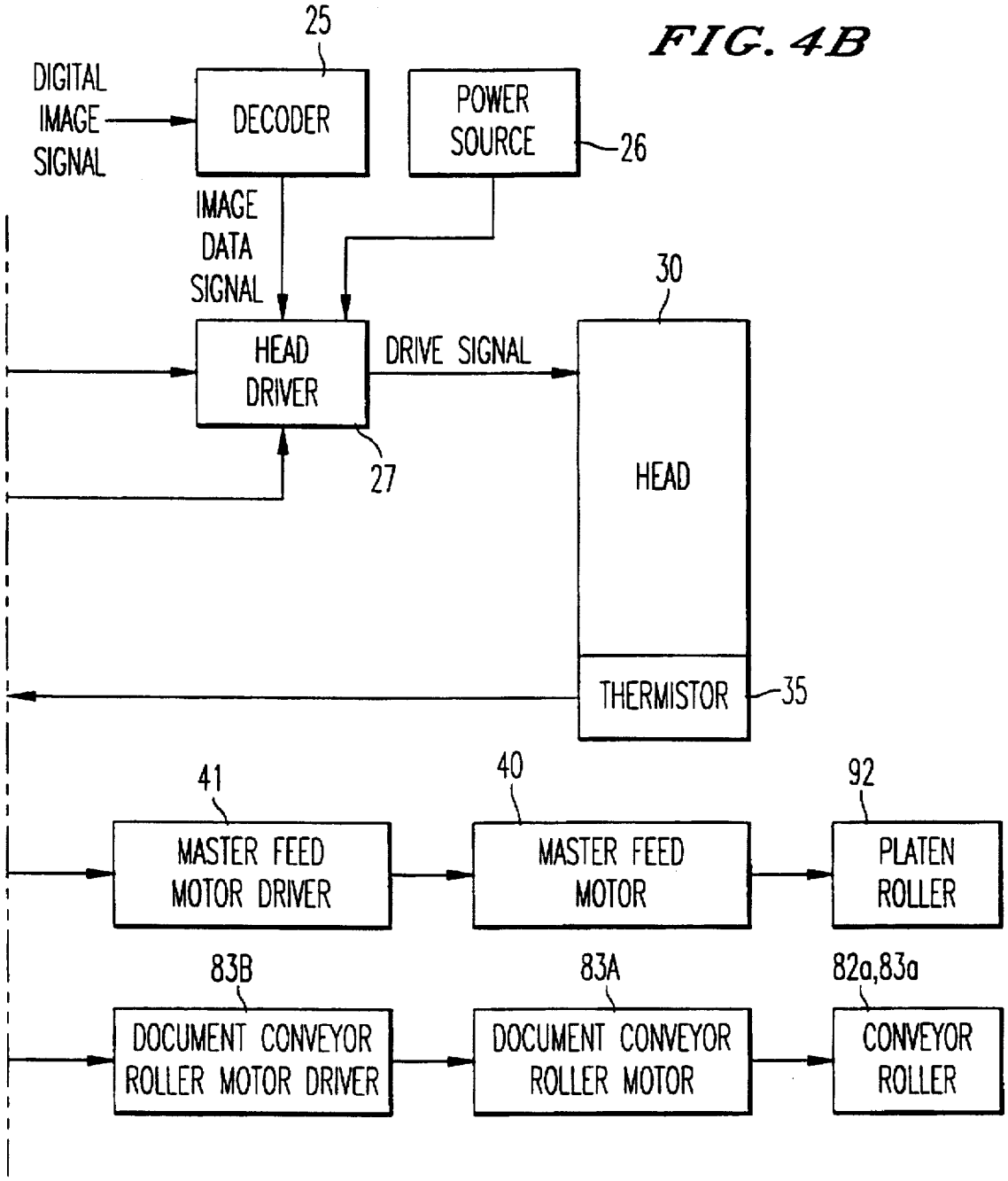
Figure 5:
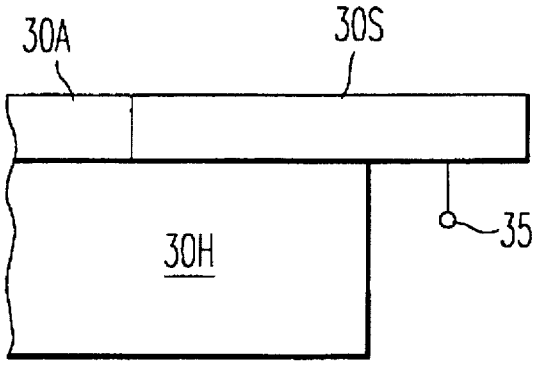
FIG. 5 is a side elevation showing a position where a thermistor responsive to the temperature of the head is located.
Figure 6:
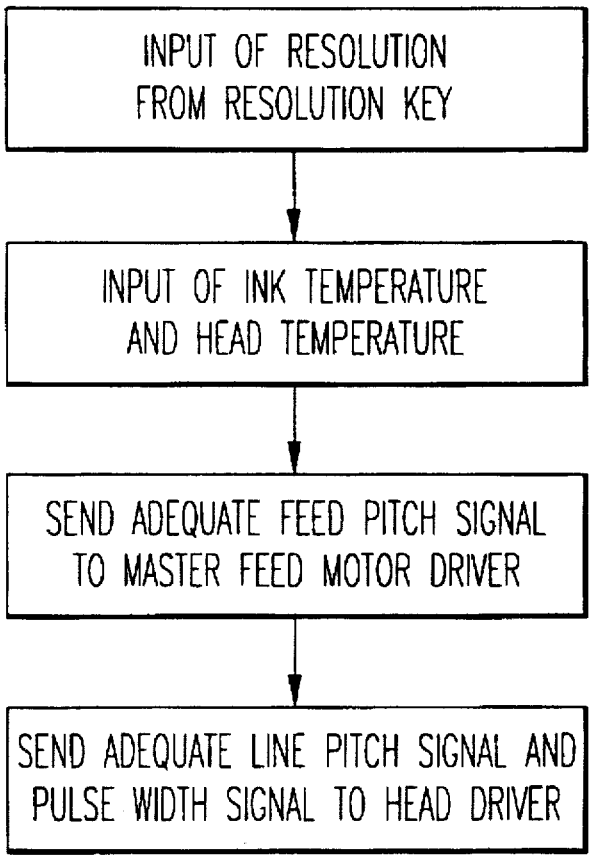
FIG. 6 is a flowchart demonstrating a specific operation of the embodiment.

As shown in FIGS. 4A and 4B, a thermistor 42 is used as means for sensing the temperature of ink existing in the ink well 107. As shown in FIGS. 4A, 4B, and 5, a thermistor 35 plays the role of a means for sensing the temperature of the head 30. Specifically, as shown in FIG. 5, the thermistor 35 is mounted on a thermal head board 30S which is a circuit board carrying the head 30 thereon, thereby sensing the temperature of the head 30. Also shown in FIG. 5 are a portion 30A accommodating the heating elements of the head 30, and a radiator made of aluminum. The thermistors 35 and 42 are connected to a microcomputer 20 which will be described.

How the embodiment changes the resolution in the subscanning direction will be described with reference to FIGS. 4A and 4B. The microcomputer 20 controls the entire printer system by interchanging command signals and data signals with a head driver 27, a master feed motor driver 41, a document conveyor roller motor driver 83B, the resolution key 10, and thermistors 35 and 42, as will be described later specifically. The microcomputer 20 includes a CPU (Central Processing Unit), I/O (Input/Output) ports, ROM (Read Only Memory) and a RAM (Random Access Memory) which are interconnected by a signal bus. Further, the microcomputer 20 includes a first drive control means, a heating interval control means, a second drive control means, and an energy control means. The first drive control means controls the master feed motor 40 to change the feed pitch in response to the output of the resolution key 10. The heating interval control means increases, when a high resolution in the subscanning direction is selected as represented by the output of the key 10, the interval between the consecutive heating times of each heating portion of the head 30 (line period). The second drive control means controls the document conveyor roller motor 83A to set up a feed pitch matching the resolution selected on the key 10. The energy control means controls the energy to be fed to each heating portion on the basis of the head temperature and ink temperature sensed by the thermistors 35 and 42, respectively.

The ROM of the microcomputer 20 stores relation data for allowing a feed pitch matching a desired resolution in the subscanning direction to be set up, relation data for allowing the line period of the heating portions of the head 30 to be increased when the resolution is high, an energy control program, relation data representing a relation between the ink temperature and the head temperature for producing an adequate image, and relation data representing perforation energy matching the ink temperature and head temperature. Such relation data are determined by experiments beforehand.

As shown in FIG. 4, the outputs of the resolution key 10 and thermistors 35 and 42 are connected to the I/O ports of the microcomputer 20. A decoder 25 decodes the digital image signal from the ADC board to reproduce the image data signal. The image data signal is fed from the decoder 25 to the head driver 27. The decoder 25 is connected to the master feed motor driver 41 by a signal line, not shown. The master feed motor driver 41 is connected to the master feed motor 40. The driver 41 feeds the output of a 1–2 phase drive circuit, which generates 1–2 phase drive pulses, to the master feed motor 40.

The head driver 27 generates a head drive signal in response to the image data signal from the decoder 25, a signal indicating a single subscanning, and a pulse width signal, line period signal and data signal from the microcomputer 20. The head 30 includes a shift register for sequentially shifting one scanning line of image data, a latch circuit for latching the outputs of the consecutive stages of the shift register, AND gates for driving only the heating portions of the head 30 corresponding to black pixels, transistors for driving the heating portions of the head 30, and diodes for intercepting reverse current.

A power source 26 is connected to the head driver 27. Electric energy for perforating the stencil 61 is fed from the power source 26 to the heating portions of the head 30 via the head driver 27. The document conveyor roller motor driver 83B, like the master feed motor driver 41, feeds the output of a 1–2 phase drive circuit to the document conveyor roller motor 83A.

A procedure for changing the resolution in the subscanning direction will be described with reference to FIGS. 4A, 4B, 6, 7A, 7B, 8A and 8B. Before pressing the master start key, the operator presses the resolution key 10 to select a desired resolution in the subscanning direction. In response to the output of the key 10, the microcomputer 20 delivers to the master feed motor driver 41 a signal for driving the motor 40 at a pitch matching the resolution. At the same time, the microcomputer 20 sends to the document conveyor roller motor driver 83B a signal for driving the motor 83A at a pitch also matching the resolution. Further, the microcomputer 20 sets up a line period matching the resolution, i.e., a comparatively long line period when the resolution is high. A signal representing such a line period is sent from the microcomputer 20 to the head driver 27. On receiving the pitch signal from the microcomputer 20, the master feed motor driver 41 drives the motor 40 which in turn drives the platen roller 92. As a result, the stencil 61 is conveyed at a predetermined pitch and a predetermined speed.

In response to the pitch signal from the microcomputer 20, the document conveyor roller motor driver 83B drives the motor 83A which in turn drives the document conveyor rollers **82*a*, 82*b*, 83*a* and 83*b*. Hence, the document 60 is conveyed at a predetermined pitch and a predetermined speed. In response to the resolution signal from the key 10, the microcomputer 20 sets up, on the basis of the head temperature and ink temperature respectively sensed by the thermistors 35 and 42, a pulse width capable of forming perforations of optimal size. A signal representing the pulse width is sent from the microcomputer 20 to the head driver 27. The head driver 27, connected to the power source 26, generates a head drive signal in response to the line period signal and pulse width signal and feeds it to the heating portions of the head 30 corresponding to black pixels. As a result, such heating portions generate Joule heat and perforates the stencil 61**.

Figure 8A:
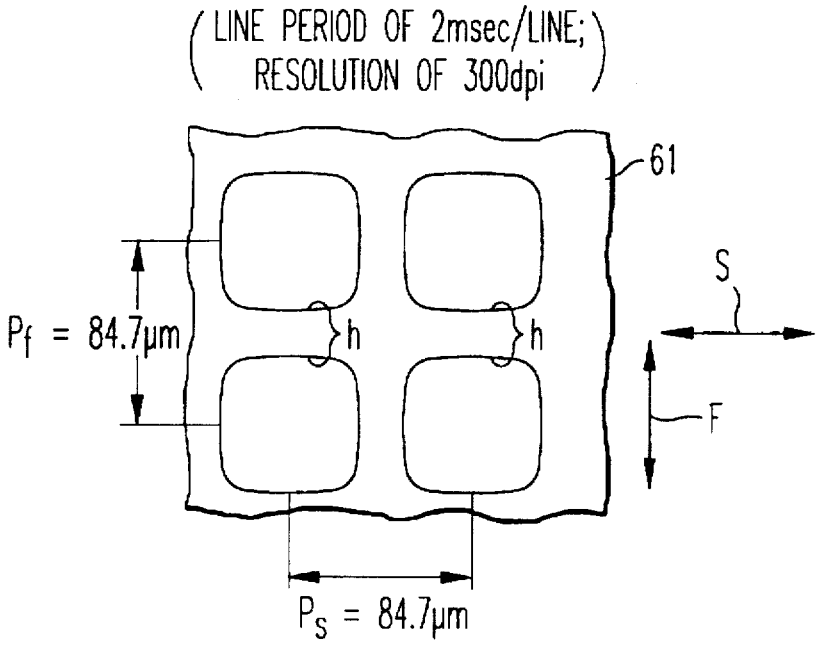
FIGS. 8A, 8B, 9A and 9B each shows a particular condition in which a stencil is perforated.
Figure 8B:
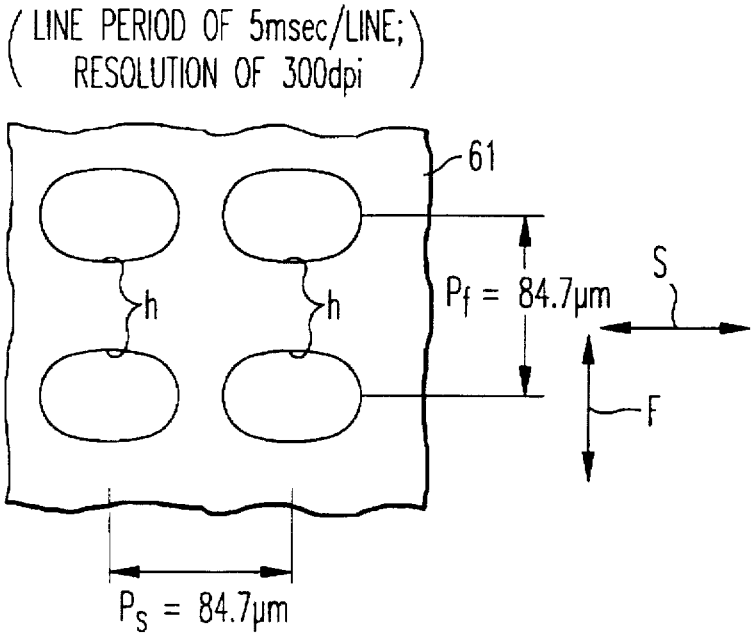

A relation between the line period and the perforating condition of the stencil 61 will be described for each of the resolutions of 300 dpi and 400 dpi in the subscanning direction. FIGS. 8A and 8B each shows perforations produced by the head 30 having a resolution of 300 dpi and the resolution of 300 dpi in the subscanning direction F. Specifically, assume that the feed pitch Pf of the stencil 61 is 84.7 μm/line, and that the line period is 2 msec/line (FIG. 8A) or 5 msec/line (FIG. 8B). For the two cases shown in FIGS. 8A and 8B, use is made of the same electric energy for perforation, i.e., the same pulse width. As shown, a change in line period causes the configuration of perforations to change. As shown in FIG. 8A, when the line period is decreased, perforations h in the stencil 61 increase in size in the subscanning direction F. Conversely, as shown in FIG. 8B, when the line period is increased, the perforations h decrease in size.

Figure 9A:
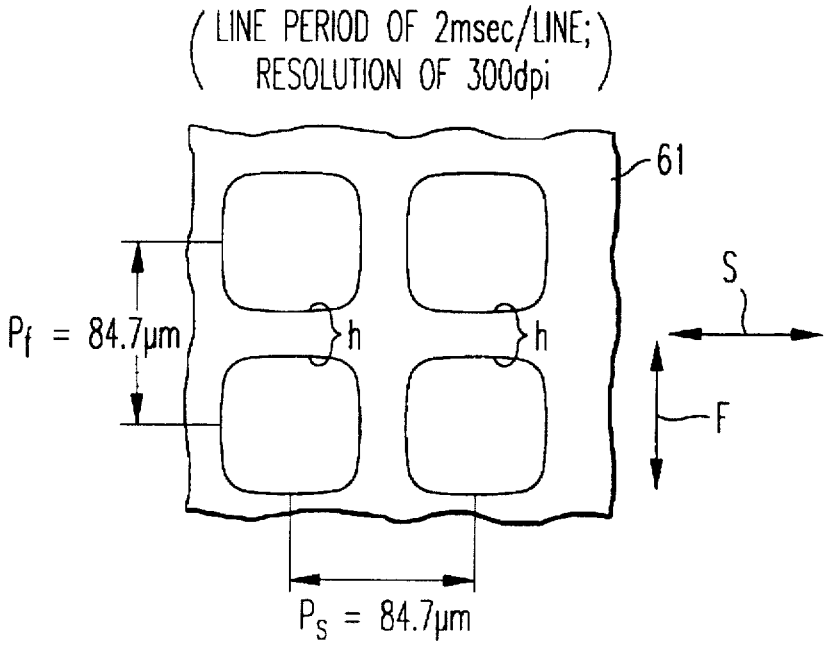
Figure 9B:
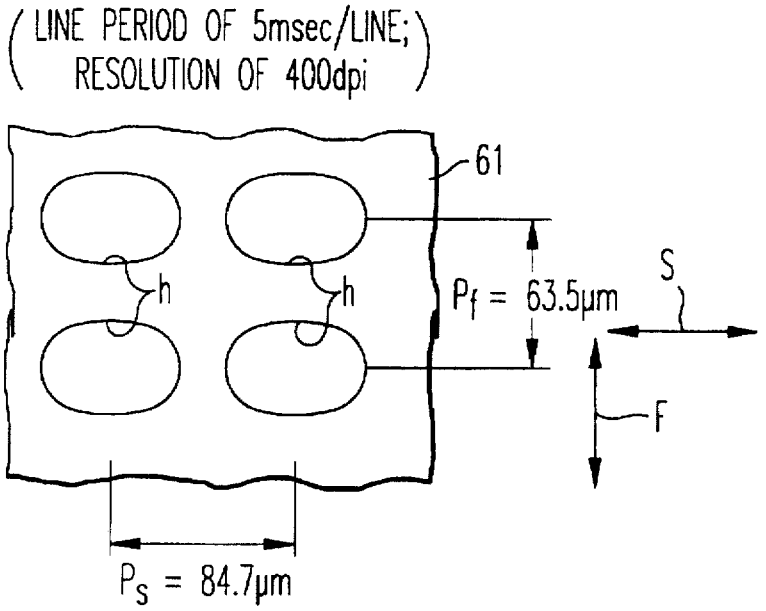

FIGS. 9A and 9B show perforations produced by the head 30 whose resolution is 300 dpi and by the resolutions of 300 dpi and 400 dpi, respectively. Specifically, perforations of FIG. 9A are formed under the same conditions as the perforations of FIG. 8A, i.e., by the resolution of 300 dpi in the subscanning direction F, stencil feed pitch Pf of 84.7 μm/line, and line period of 2 msec/line. Perforations of FIG. 9B are produced by the resolution of 400 dpi in the direction F, i.e., by the feed pitch Pf of 63.5 μm/line and the line period of 5 msec/line. The two different kinds of perforations are derived from the same energy or pulse width. As shown in FIGS. 9A and 9B, a change in line period causes the configuration of perforations to change. As shown in FIG. 9A, when the line period is decreased, perforations h in the stencil 61 increase in size in the subscanning direction F. Conversely, as shown in FIG. 9B, when the line period is increased, the perforations h decrease in size. As FIG. 9B indicates, even when the resolution in the direction F is increased from 300 dpi to 400 dpi, the perforations h are prevented from being joined together in the main scanning direction S and subscanning direction F. Such discrete perforations, matching the resolution in the direction F, insure an optimal image matching the desired resolution.

Assume that the higher resolution of 400 dpi is selected, and that the line period is lowered to 5 msec/line, as shown in FIG. 9B. Then, the perforations are spaced apart in the subscanning direction F as adequately as in FIG. 9A, so that an image free from irregularities can be formed on a sheet by the spread of the ink. By contrast, assume that the lower resolution of 300 dpi is maintained, and that the line period is lowered to 5 msec/line, as shown in FIG. 8B. Then, the resulting perforations are excessively spaced apart in the direction F, compared to the perforations of FIG. 9A. Such perforations result in the insufficient spread of the ink on a sheet and, therefore, in white stripes in an image.

Why the configuration of perforations changes as stated above will be described with reference to FIGS. 4A, 4B, 7A and 7B. Increasing the line period means decreasing the rotation speed of the platen roller 92, i.e., the rotation speed of the master feed motor 40. In FIG. 8B, a period of time of 5 msec/line is necessary for the stencil 61 to be fed by the feed pitch Pf of 84.7 μm/line, so that the feed speed is about 16.9 μm/msec. Likewise, in FIG. 9B, a period of time of 5 msec/line is necessary for the stencil 61 to be fed by the feed pitch Pf of 63.5 μm/line, so that the feed speed is about 12.7 μm/msec. Further, in FIGS. 8A and 9A, a period of time of 2 msec/line is necessary for the stencil 61 to be fed by the feed pitch of 84.7 μm/line, so that the feed speed is about 42.4 μm/msec.

Figure 7A:
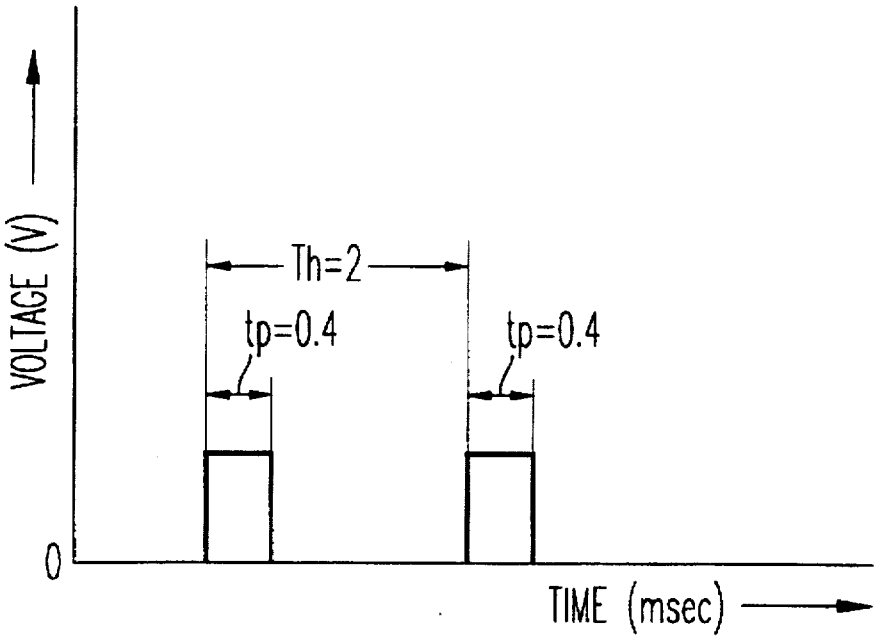
FIGS. 7A and 7B each indicate a relation between the line period, or heating time interval, and the pulse width.
Figure 7B:
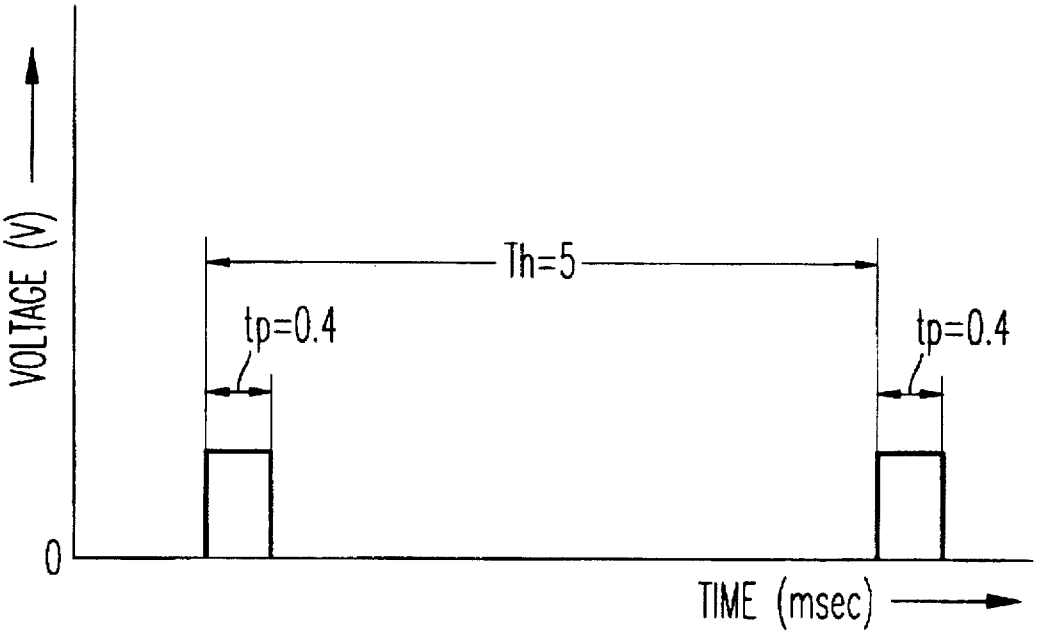

Assume that the line period is increased, that the feed speed of the stencil 61 is lowered, and that the pulse width tp, FIGS. 7A and 7B, is the same. Then, the portion of the stencil 61 conveyed in contact with the head 30 for a period of time corresponding to the pulse width tp is reduced, reducing the diameter of the perforations h in the subscanning direction F. Moreover, an increase in line period Th, FIGS. 7A and 7B, generally results in a decrease in the heat to accumulate in the heating portions of the head 30 due to radiation and other causes. This further reduces the diameter of the perforations h in the direction F. Although a decrease in line period Th slightly enlarges the perforations h in the main scanning direction S, the enlargement is negligible and not shown in FIGS. 8A–9B in order to clearly indicate the characteristic of the embodiment.

When only the line period was changed on the basis of a resolution in the subscanning direction, perforations having the following diameters were formed in a stencil.

| Resolution | 300 dpi | 400 dpi |
|---|---|---|
| Line period (msec/line) | 2 | 5 |
| Diameter (μm) | 68.1 | 55.3 |

The above results were obtained with a thermal head having a resolution of 300 dpi and heating elements sized 45 μm in the main scanning direction and 48 μm in the subscanning direction each. The head was heated to 20° C. The pulse width was 400 μsec (0.4 msec).

When the line period and resolution are respectively 2 msec/line and 300 dpi, as shown in FIG. 9A, the stencil 61 moves 84.7 μm for 2 msec or moves (84.7 μm/line)÷(2 msec/line)×0.4 msec≈17 μm for tp=0.4 msec. On the other hand, when the line period and resolution are respectively 5 msec/line and 400 dpi, as shown in FIG. 9B, the stencil 61 moves 63.5 μm for 5 msec or moves only (63.5 μm/line)÷(5 msec/line)×0.4 msec≈5 μm for 0.4 msec. This, coupled with the heat accumulated in the heating portions of the head 30 and the shrinkage of the resin film of the stencil 60, provides the diameters 68.1 μm and 55.3 μm as listed above.

As stated above, the embodiment successfully formed optimal perforations h matching a resolution in the subscanning direction F and discrete in both the main scanning direction S and the subscanning direction F. Image quality available with such perforations was desirable.

Preferably, each heating element of the head 30 should be sized, in the subscanning direction, less than 80% of the feed pitch associated with the highest resolution which is available with the resolution setting means. Specifically, since the highest resolution available with the resolution key 10 of the embodiment is 400 dpi and the feed pitch associated therewith is 63.5 μm/line, the heating element should preferably be sized smaller than 51 μm in the subscanning direction. By so dimensioning the heating elements, it is possible to prevent the perforations from being joined together in the subscanning direction more positively even when the resolution in the subscanning direction is increased.

Further, each heating element of the head 30 should preferably be sized more than 40% of the feed pitch associated with the highest resolution available with the resolution setting means. Specifically, since the highest resolution available with the resolution key 10 is 400 dpi and the feed pitch associated therewith is 63.5 μm/line, the heating element should preferably be sized greater than 25 μm in the subscanning direction. Such a size also promotes sure perforation. Should the heating elements be excessively small, their life would be reduced due to repeated heat generation.

In many of a series of experiments, use was made of a thermal head having a resolution of 400 dpi and heating portions sized 30 μm in the main scanning direction and 40 μm in the subscanning direction each, and the line period was maintained constant at 3 msec/line. In these experiments, the temperature of the head did not change, and the pulse width was changed only on the basis of the ink temperature. Specifically, when the ink temperature was 10° C., 20° C. and 30° C., the pulse width, ink viscosity (flow value as prescribed by JIS-K5701), perforation diameter, and image density (Macbeth densitometer) were measured, as listed below. For the experiments, use was made of a 40 μm thick stencil made up of a porous substrate implemented by Japanese paper, and a thermoplastic resin film adhered to the substrate.

| Ink temperature | 10° C. | 20° C. | 30° C. |
|---|---|---|---|
| Pulse width (μS) | 600 | 530 | 460 |
| Ink viscosity (mm) | 27.8 | 29.5 | 32.2 |
| Perforation diameter (μm) | 55 | 52 | 48 |
| Image density | 0.95 | 0.95 | 0.95 |

It will be seen that the image density remains constant without regard to the ink temperature.

As described above, the embodiment insures attractive images at all times without regard to the fluidity of ink which depends on the temperature of ink. The embodiment controls the perforation size in terms of energy to be fed to the head 30 and in accordance with the ink temperature or the ink temperature and head temperature. This kind of scheme makes it needless to change the mechanical condition or the sequence of the printer and, therefore, stabilizes image density surely and easily. With a conventional scheme, it is necessary to mechanically adjust the pressure to act between a stencil and a sheet or the printing speed.

If the temperature inside the printer is stable, the ink temperature is substantially equal thereto. In such a case, the temperature inside the printer may be sensed in place of the ink temperature for controlling the perforation size. However, since the temperature inside the printer generally depends on the operating condition and differs from the ink temperature, the image density cannot be as stable as in the embodiment.

The printer described above is operable with a stencil substantially implemented only by the thermoplastic resin film. This kind of stencil may even be implemented as a thermoplastic resin film containing a small amount of antistatic agent or the like, or a thermoplastic film resin film provided with one or more overcoat layers or similar thin layers on at least one of opposite major surfaces thereof. For example, when a 2 μm thick stencil of this kind was perforated under the same conditions as in the embodiment, perforations were formed as discretely as in the embodiment and provided desired image quality matching a resolution in the subscanning direction. In addition, the transfer of ink from the front of the underlying sheet to the rear of the overlying sheet was minimized.

In the illustrative embodiment, when priority is given to a shorter master making time rather than to image quality, the resolution in the subscanning direction may be lowered to reduce the line period. Conversely, when priority is given to image quality, the resolution may be increased to decrease the line period; although the master making time increases, high quality images are achievable.

Figure 10:
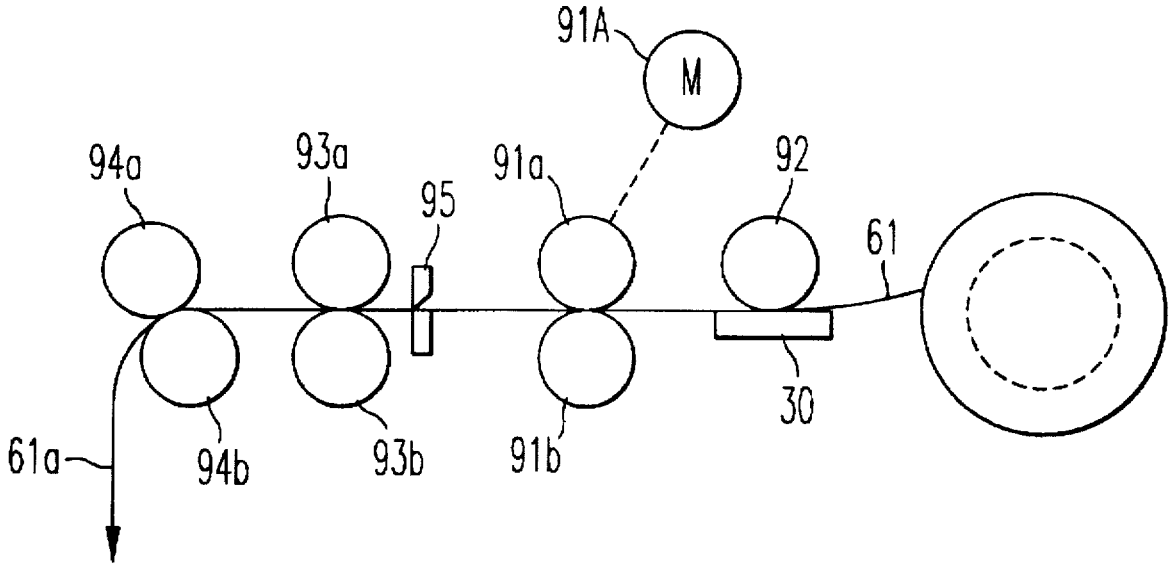
FIG. 10 shows a modified form of a stencil conveying means included in the embodiment.

Referring to FIG. 10, another specific form of the stencil conveying means is shown. The master making and feeding section shown in FIG. 10 is similar to the section 90 of FIG. 1 except for the following. As shown, a conveyor roller pair, or stencil conveying means, 91*a* and 91*b* is located downstream of the platen roller 92. A master feed motor, or drive means, 91A is implemented as a stepping motor and drivably connected to the drive roller 91*a* by a timing belt, not shown. The master feed motor 40 is omitted, so that the platen roller 92 is rotated by the stencil 61. In this configuration, the master feed motor 91A causes the roller pair 91*a* and 91*b* to convey the stencil 61 while the platen roller 92 simply follows the movement of the stencil 61.

While the embodiment allows the resolution in the subscanning direction to be changed either to 300 dpi or to 400 dpi stepwise, an arrangement may be so made as to change the resolution between 200 dpi and 400 dpi continuously. To set up a feed pitch matching the resolution, use may be made of a mechanism taught in, for example, Japanese Utility Model Laid-Open Publication No. 59-161765. Of course, the intermittent feed of the stencil 61 shown and described may be replaced with continuous feed, if desired.

To read the document 60, the embodiment conveys it by rotating the roller pairs via the motor 83A. Alternatively, a system may be used in which the document 60 is held stationary on the glass platen, and optics including a lamp and mirrors is moved by a motor relative to the document. In such a case, the motor will be so controlled as to change the moving speed of the optics to a feed pitch matching a desired resolution in the subscanning direction.

Furthermore, the thermistor 35 may be disposed in the aluminum radiator 30H, if desired.

The head driver 27 may be constructed and operated as taught FIG. 1 of Japanese Utility Model Laid-Open Publication No. 2-65560. The head driver disclosed in this Laid-Open Publication has a driver, a plurality of pulse width generators, and a selector. The driver generates a head drive signal in response to the image data signal from the decoder 25, signal indicating a single subscanning, and line period command and data signal from the microcomputer 20. The pulse width generators are built in the driver, and each generates a head drive signal having a particular pulse width matching a resolution in the subscanning direction. The selector selects one of the outputs of the pulse width generators.

As described above, the illustrative embodiment has various advantages as enumerated below.

(1) When the resolution in the subscanning direction selected on the resolution setting means is high, the heating interval control means increases the interval between the consecutive heating times. As a result, perforations to be formed in a stencil are controlled to an adequate size in the subscanning direction. The heating portions of the head are each sized, in the subscanning direction, smaller than a feed pitch corresponding to the highest resolution available with the resolution setting means. This prevents the perforations from being joined together. Consequently, image quality matching the resolution in the subscanning direction can be achieved at all times, and the transfer of ink from the underlying sheet to the overlying sheet is minimized.

(2) The energy control means controls, on the basis of ink temperature sensed by the ink temperature sensing means, energy to be applied to each heating portion of the head. This also prevents the perforations from being joined together. Hence, image quality matching the resolution in the subscanning direction can be achieved at all times, and the transfer of ink from the underlying sheet to the the overlying sheet is minimized (3) The energy control means further controls, on the basis of the head temperature sensed by the head temperature sensing means as well as the ink temperature, the energy to be applied to each heating portion of the head. Hence, image quality matching the resolution in the subscanning direction can be achieved at all times, and the transfer of ink from the underlying sheet to the overlying sheet is minimized (4) Since use is made of a stencil implemented substantially only by a thermoplastic resin film, images free from fiber marks can be printed on sheets.

2nd Embodiment

Figure 11:
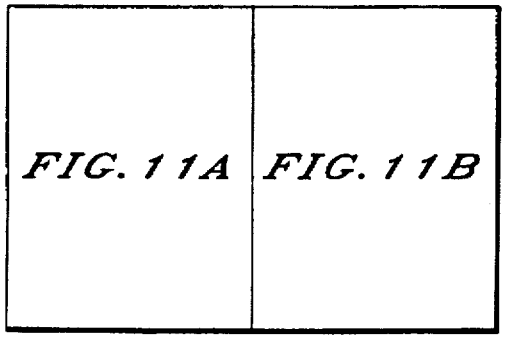
FIG. 11, which consists of FIGS. 11A and 11B, is a block diagram schematically showing a second embodiment of the control device in accordance with the present invention.
Figure 11A:
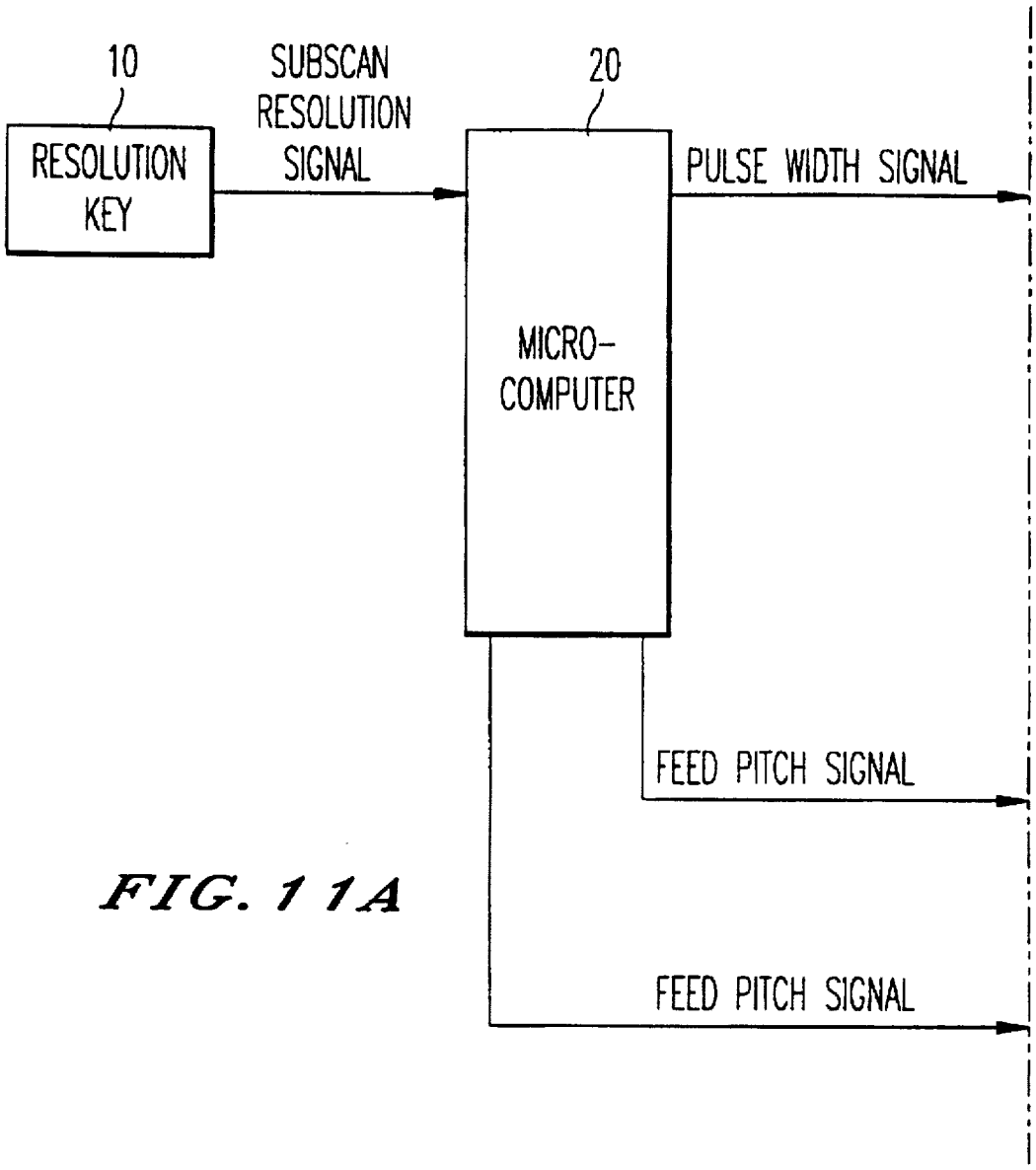
Figure 11B:
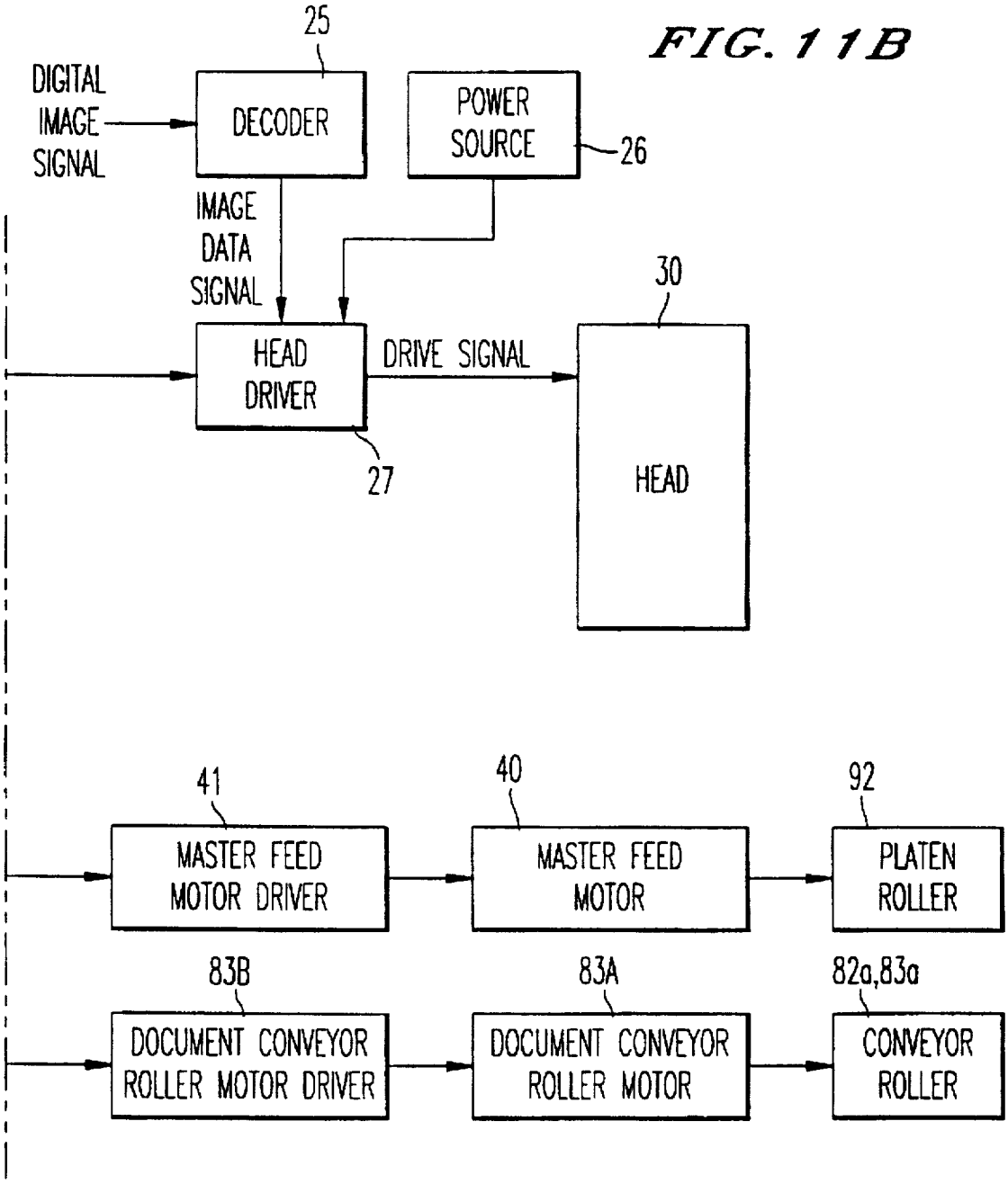

An alternative embodiment of the present invention will be described. As shown in FIGS. 11*a* and 11B, this embodiment is similar to the previous embodiment except that the thermistors 35 and 42, FIGS. 4A and 4B, are omitted. How the alternative embodiment changes the resolution in the subscanning direction will be described with reference to FIGS. 11A, 11B, 12A, 12B, 13, 14A, 14B and 15.

Before pressing the master start key, the operator presses the resolution key 10 to select a desired resolution in the subscanning direction. In response to the output of the key 10, the microcomputer 20 delivers to the master feed motor driver 41 a signal for driving the motor 40 at a pitch matching the resolution. At the same time, the microcomputer 20 sends to the document conveyor roller motor driver 83B a signal for driving the motor 83A at a pitch also matching the resolution. Further, the microcomputer 20 sends to the head driver 27 a signal representing a pulse width for forming perforations of optimal size matching the resolution. On receiving the pitch signal from the microcomputer 20, the master feed motor driver 41 drives the motor 40 which in turn drives the platen roller 92. As a result, the stencil 61 is conveyed at a predetermined pitch and a predetermined speed.

In response to the pitch signal from the microcomputer 20, the document conveyor roller motor driver 83B drives the motor 83A which in turn drives the document conveyor rollers 82*a*, 82*b*, 83*a* and 83*b*. Hence, the document 60 is conveyed at a predetermined pitch and a predetermined speed.

As stated above, the head driver 27 receives power from the power source 26 on the basis of the pulse width signal and feeds pulses (head drive signal) to the heating portions of the head 30. In response, the heating portions corresponding to black signals generate Joule heat for thereby perforating the stencil 61.

A relation between the pulse width setting system and the perforating condition of the stencil 61 will be described with reference to FIGS. 12A, 12B, 13, 14A, 14B and 15. Assume that the head 30 has a resolution of 300 dpi in the main scanning direction, that resolutions of 300 dpi and 400 dpi are available in the subscanning direction, and that the line period Th of the head 30 remains the same for all the pulse width setting systems to be described.

Figure 12A:
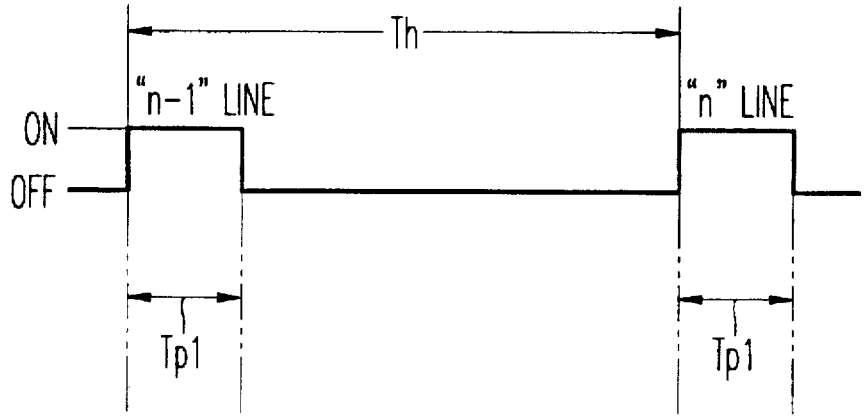
FIGS. 12A and 12B show a specific pulse width setting system available with the second embodiment.
Figure 12B:
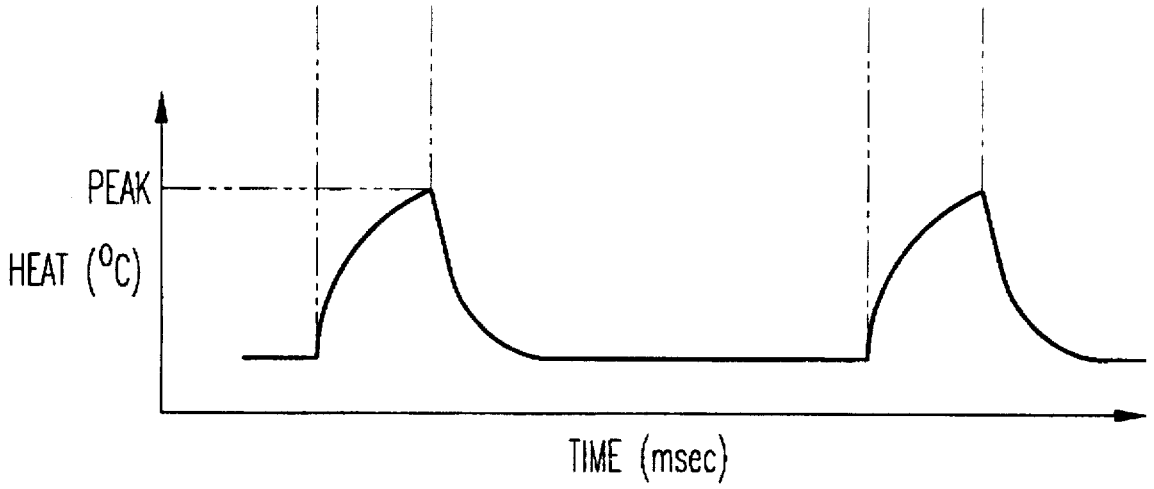
Figure 13:
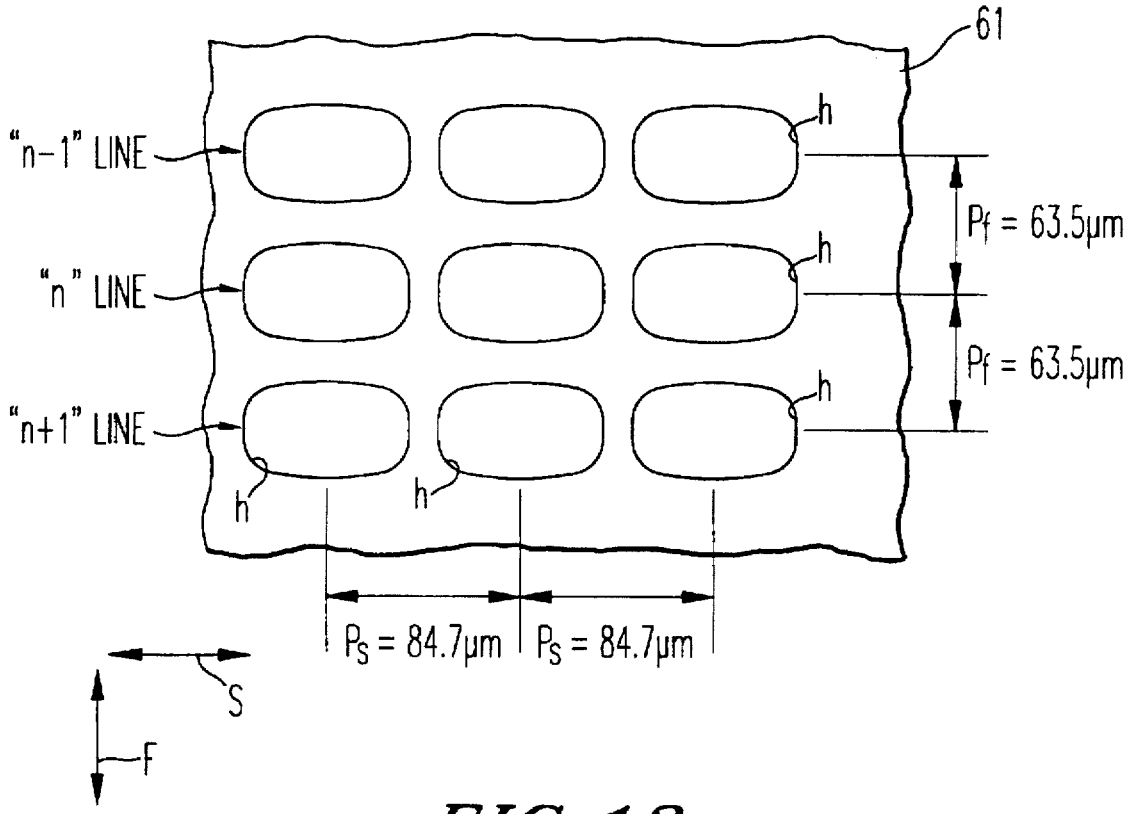
FIG. 13 shows a stencil perforated by the system shown in FIGS. 12A and 12B.

FIGS. 12A, 12B and 13 demonstrate a case wherein the resolution in the subscanning direction F is 400 dpi. As shown in FIG. 13, the stencil 61 is fed at a pitch Pf of 63.5 μm/line due to the resolution of 400 dpi. As shown in FIG. 12A, a single pulse having a width tp1 is applied to any one of the heating portion of the head 30. Then, the temperature of the heating portion rises and then falls in a substantially saw-tooth configuration, as shown in FIG. 12B. As a result, as shown in FIG. 13, perforations h which are discrete in the main scanning direction S and subscanning direction F are formed in the stencil 61; each perforation h has an optimal size matching the resolution of 400 dpi.

Figure 14A:
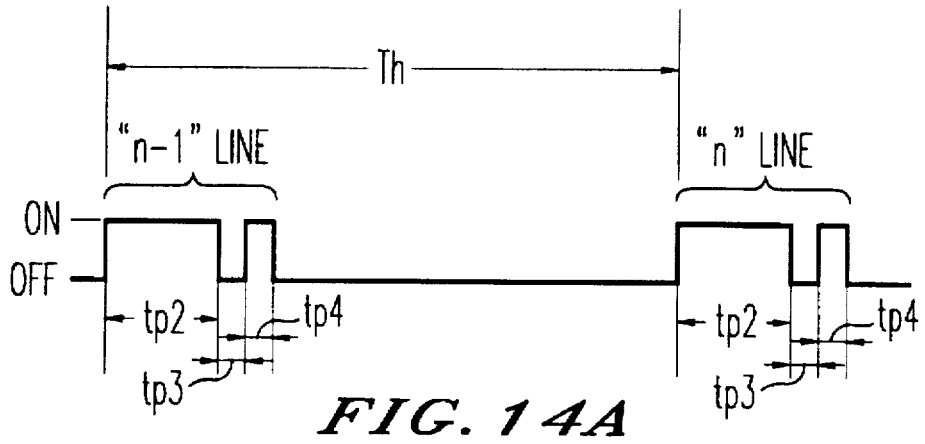
FIGS. 14A and 14B show another specific pulse width setting system available with the second embodiment.
Figure 14B:
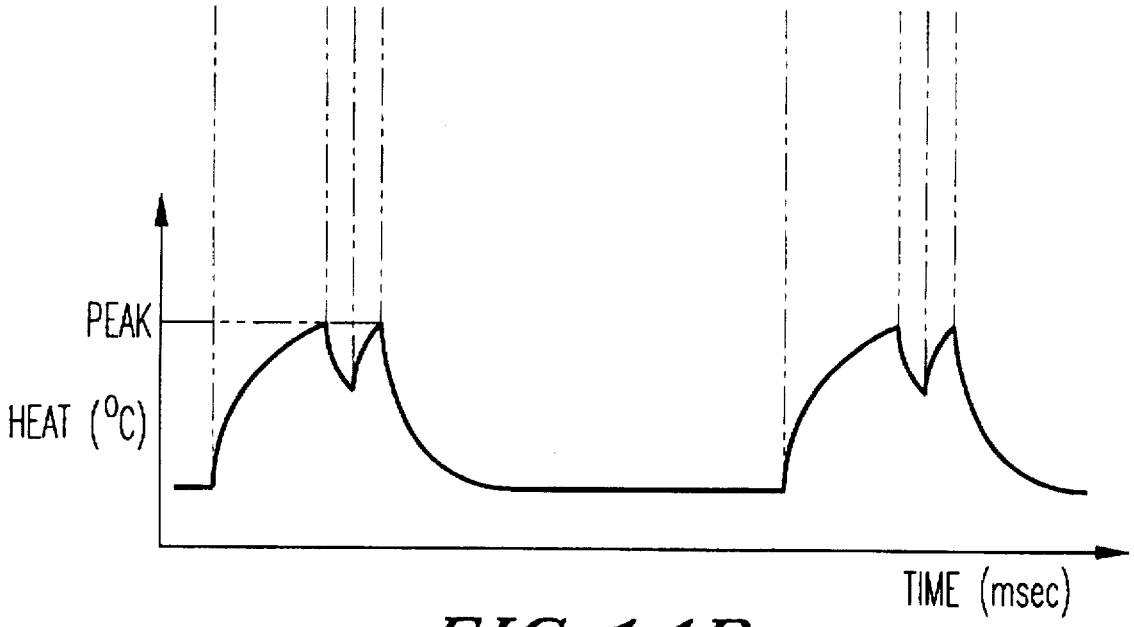
Figure 15:
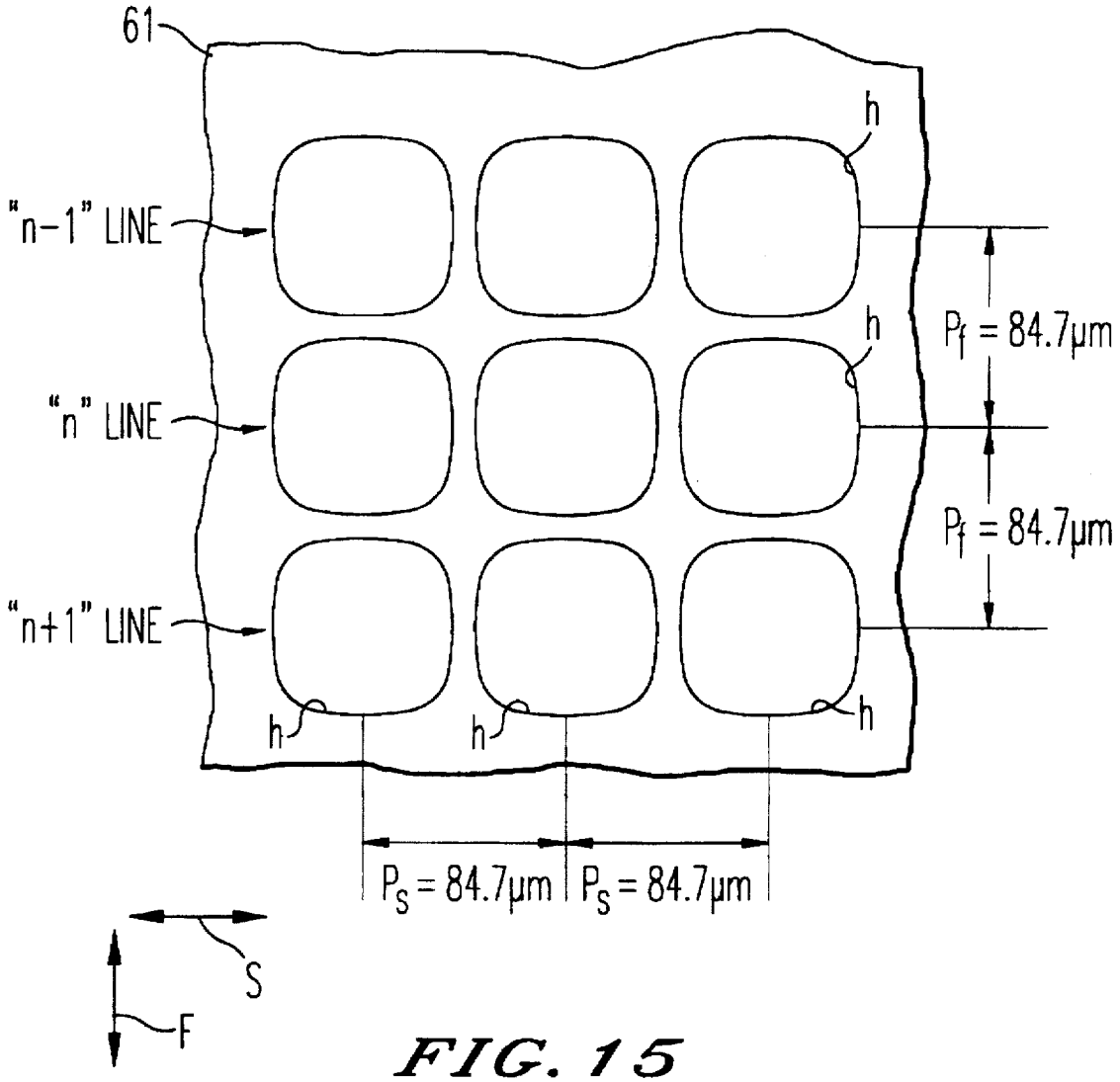
FIG. 15 shows a stencil perforated by the system shown in FIGS. 14A and 14B.

FIGS. 14A, 14B and 15 show a case wherein the resolution in the subscanning direction F is 300 dpi. As shown in FIG. 15, the feed pitch Pf of the stencil 61 is 84.7 μm/line matching such a resolution. As shown in FIG. 14A, two consecutive pulses having widths tp2 and tp4, respectively, are applied to the heating element of the head 30 for a single image signal. Then, the temperature of the heating portion rises and then falls in a substantially double saw-tooth configuration, as shown in FIG. 14B. As a result, as shown in FIG. 15, perforations h which are discrete in the two directions S and F are formed in the stencil 61, and each is enlarged only in the direction F. Such perforations h have an optimal size matching the resolution of 300 dpi. Another advantage achievable with this system is that the perforations h can be provided with a desired size in the direction F without the peak temperature of the heating elements being increased more than necessary. This reduces the thermal stress of the heating elements and thereby extends the life of the head 30. In FIGS. 14A and 14B, labeled tp3 is an OFF time between the consecutive pulses tp2 and tp4. The size of each perforation h in the direction S does not have noticeable influence and is not shown in FIG. 15 in order to clearly indicate the characteristic of the perforations h.

Figure 16A:
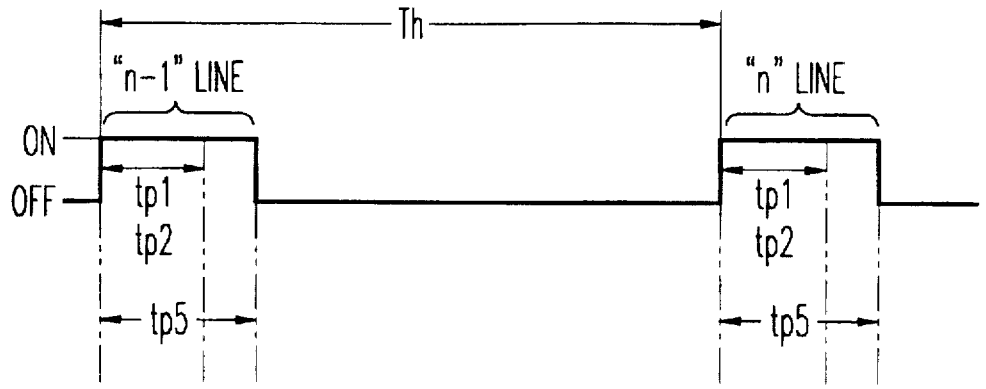
FIGS. 16A and 16B shows still another specific pulse width setting system available with the second embodiment.
Figure 16B:
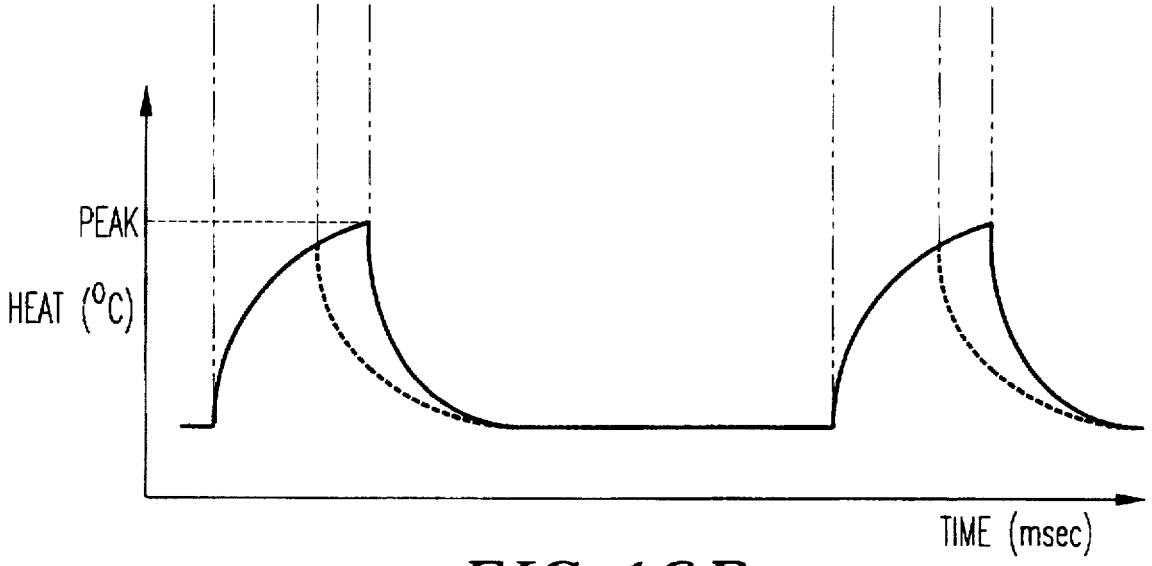
Figure 17C:
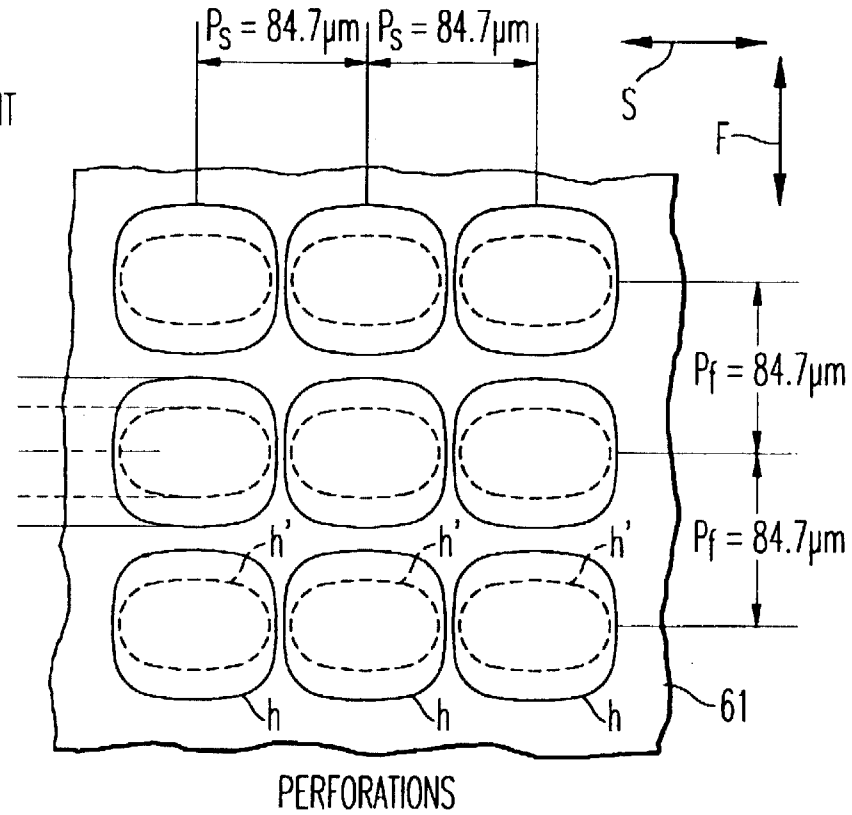
FIG. 17 shows a stencil perforated by the system shown in FIGS. 16A and 16B.
Figure 17B:
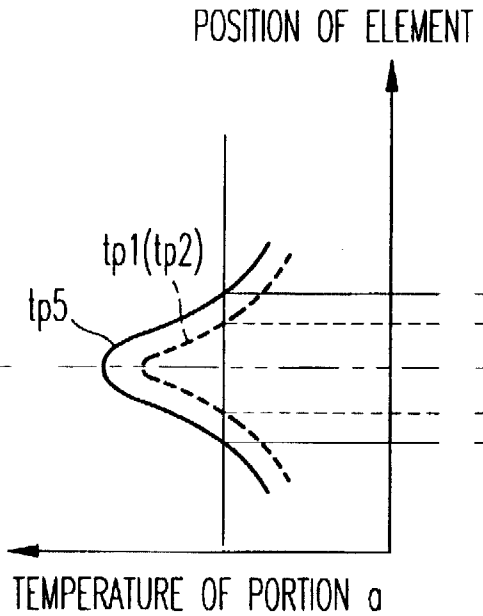
Figure 17A:
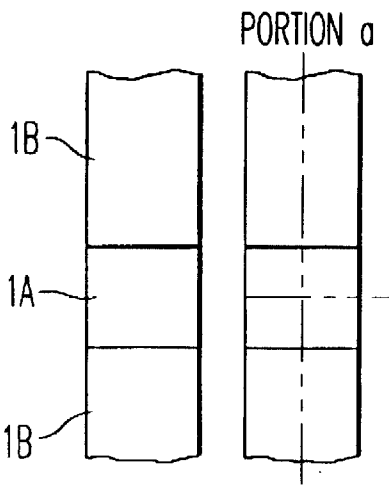

Another pulse width setting system feasible for the resolution of 300 dpi in the subscanning direction F is as follows. As shown in FIGS. 16A and 16B, so long as the thermal stress of the heating elements of the head 30 is negligible in respect of service life, a single pulse having a width tp5 may be applied to each heating element for a single image signal. The pulse width tp5 is selected to be greater than the pulse width tp1, FIG. 12A, for the resolution of 400 dpi and the pulse width tp2, FIG. 14A, for the previously stated 300 dpi condition. Specifically, when a pulse whose duration is tp1 (or tp2) is applied to each heating element of the head 30, as shown in FIG. 16, the temperature of the heating element changes as indicated by a phantom line in FIG. 16B. In this condition, the stencil 61 is perforated as indicated by phantom lines in FIG. 17. Perforations h' shown in FIG. 17 are optimal in size for the resolution of 400 dpi, but they are too small to implement the resolution of 300 dpi. This is why the pulse width tp5 greater than tp1 and tp2 is selected.

The system using the pulse width tp5 as stated above elevates the peak temperature of the heating element of the head 30, as shown in FIGS. 16A and 16B. At the same time, the temperature above the perforation threshold extends over a greater length of the heating element in the subscanning direction F, as represented by a portion a in FIG. 17. As a result, the perforations h shown in FIG. 17 are formed in the stencil 61. The perforations h have an optimal size matching the resolution of 300 dpi in the direction F. Although the pulse width tp5 greater than tp1 (or tp2) slightly increases the perforation size in the main scanning direction S also, the increase in size in the direction S is negligible, compared to the increase in size in the direction F, and fully acceptable in practice. The system using the pulse width tp5 simplifies the control device, compared to the system applying two consecutive pulses for a single image signal.

Specific pulse widths matching the different resolutions in the subscanning direction F and selected in consideration of the foregoing are listed in Table 1 below.

TABLE 1

| Pulse Width | Resolution of 300 dpi: Two Consecutive Pulses | Resolution of 300 dpi: Single Pulse | Resolution of 400 dpi |
|---|---|---|---|
| tp1 | — | — | 470 μs |
| tp2 | 470 μs | — | — |
| tp3 | 40 μs | — | — |
| tp4 | 120 μs | — | — |
| tp5 | — | 560 μs | — |

As to the master making conditions, the head 30 has a resolution of 300 dpi in the main scanning direction S while resolutions of 300 dpi and 400 dpi are available in the subscanning direction F. The heating elements of the head 30 are each dimensioned 50 μm in the main scanning direction S and 40 μm in the subscanning direction F. The head 30 has a line period Th of 3 msec/line. A master is assumed to be made at a room temperature of 20° C. In Table 1, tp1–tp4 represent the pulse widths (time; μsec) appearing in FIGS. 12A, 12B, 14A and 14B.

With any of the specific pulse widths shown in Table 1, it is possible to form perforations matching a desired resolution in the subscanning direction F and discrete in the directions S and F in the stencil 61 under the same operating conditions. In addition, desirable image quality is achievable with such perforations.

Each heating portion of the head 30 should preferably be sized, in the subscanning direction F, less than 80% of the feed pitch corresponding to the highest resolution available with the resolution setting means, as in the first embodiment. Specifically, since the highest resolution available with the resolution key 10 of the embodiment is also 400 dpi and the feed pitch associated therewith is 63.5 μm/line, heating element should preferably be sized smaller than 51 μm in the subscanning direction. By so dimensioning the heating elements, it is possible to prevent the perforations from being joined together in the subscanning direction more positively even when the resolution in the subscanning direction is increased.

Further, each heating element of the head 30 should preferably be sized greater than 40% of the feed pitch associated with the highest resolution available with the resolution setting means. Specifically, since the highest resolution available with the resolution key 10 is also 400 dpi and the feed pitch associated therewith is 63.5 μm/line, the heating element should preferably be sized greater than 25 μm in the subscanning direction. Such a size also promotes sure perforation. Should the heating elements be excessively small, their life would be reduced due to repeated heat generation.

Figure 18A:
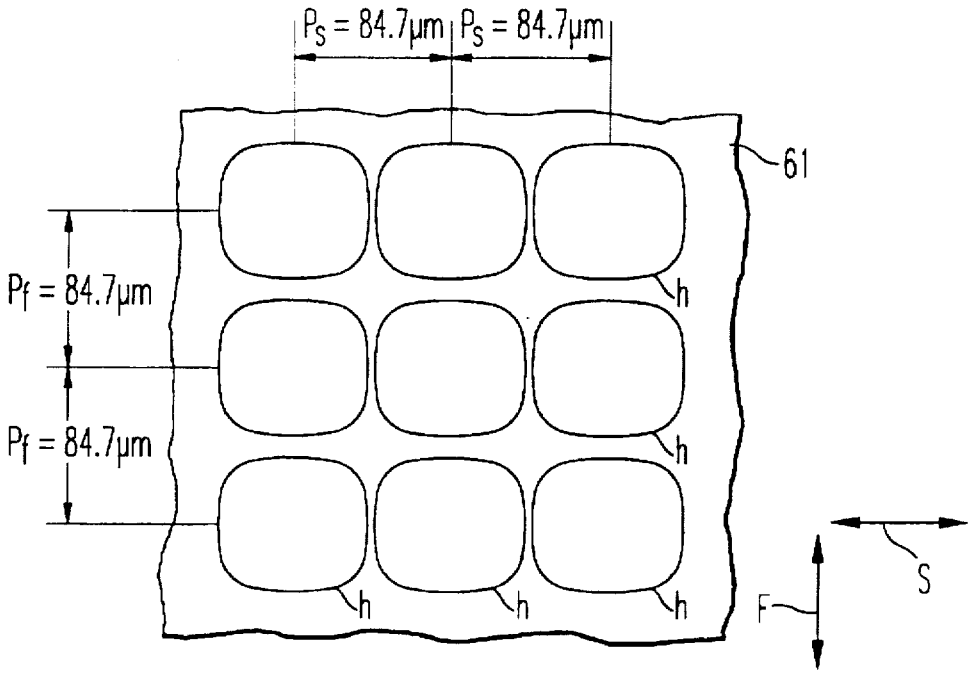
FIGS. 18A and 18B show other specific configurations of perforations formed in a stencil.
Figure 18B:
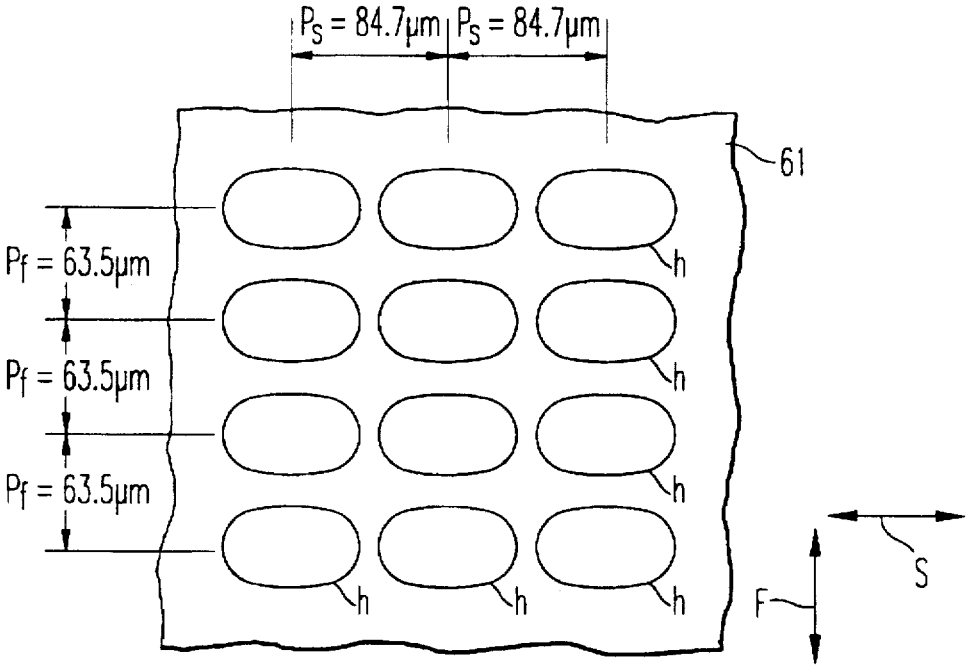

Each beating portion of the head 30 has a certain single dimension, in the subscanning direction F, matching a feed pitch which corresponds to a resolution particular to a thermosensitive stencil printer, as stated earlier. For example, assume a printer whose resolution is 300 dpi in both the main scanning direction S and the subscanning direction F. This kind of printer is operable with a thermal head in which each heating element is dimensioned 50 μm in the main scanning direction and 60 μm in the subscanning direction. FIG. 18A shows perforations h formed in the stencil 61 by such a head. On the other hand, when the resolution is 300 dpi in the direction S and 400 dpi in the direction F for enhancing image quality, a head having heating portions sized 50 μm in the main scanning direction and 40 μm in the subscanning direction is used. FIG. 18B shows perforations h formed in the stencil 61 by this kind of head.

Assuming that the line period for one line is the same, the master making time depends on the resolution in the subscanning direction F for a single document and increases with an increase in resolution. Specifically, when the resolution of the printer is 300 dpi in both of the directions S and F, the master making time decreases although the image quality falls. Conversely, when the resolution of the printer is 300 dpi in the direction S and 400 dpi in the direction F, the image quality rises although the master making time increases.

Figure 19A:
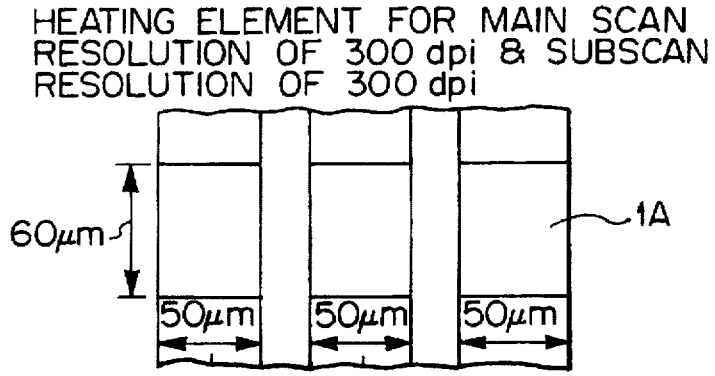
FIG. 19A shows specific dimensions of heating elements.
Figure 19B:
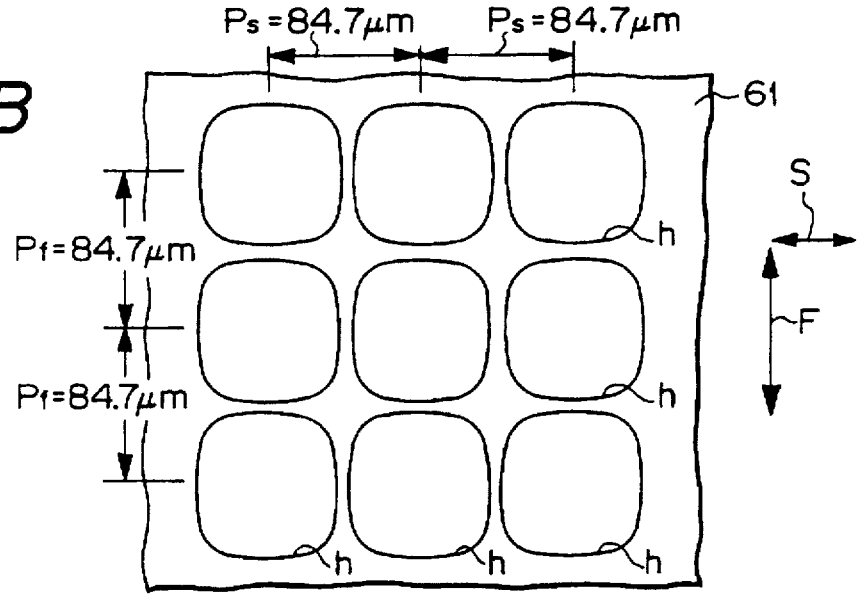
FIGS. 19B and 19C each shows perforations formed in a stencil under the condition shown in FIG. 19A.
Figure 19C:
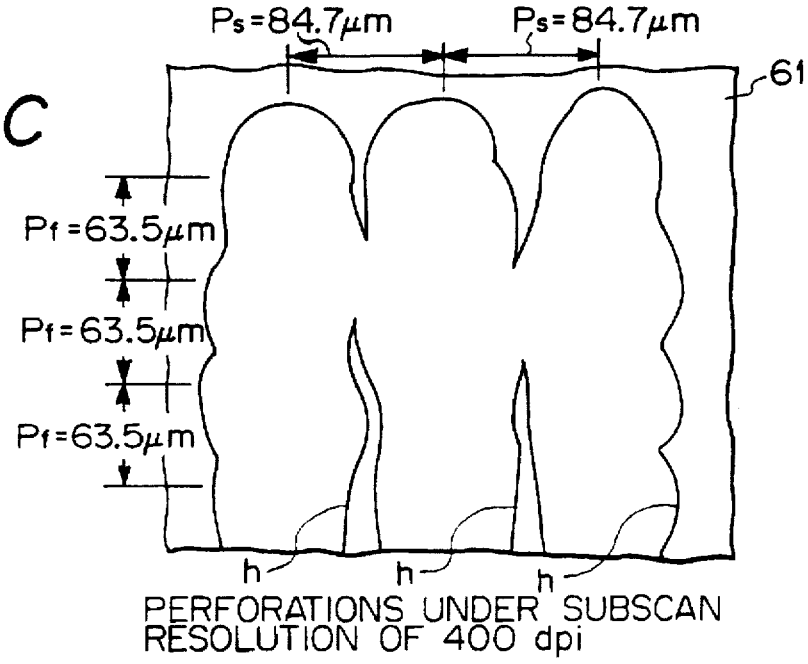

Assume that the resolution in the direction F is changed with a thermosensitive stencil printer having a given thermal head. For example, as shown in FIG. 19A, assume a thermal head whose resolution is 300 dpi in both of the directions S and F. This kind of head is capable of forming perforations of optimal size when the resolution in the direction F is 300 dpi (see FIG. 19B). However, when the resolution in the direction F is increased to 400 dpi, such a head causes the perforations to be joined together in the direction F (see FIG. 19C). As a result, more than an expected amount of ink is transferred to a sheet and then from the sheet to the rear of another sheet discharged next. On the other hand, assume a thermal head whose resolution is 300 dpi in the direction S and 400 dpi in the direction F. This head provides perforations with an optimal size so long as the resolution in the direction F is 400 dpi (see FIG. 20C). However, when the resolution in the direction F is decreased to 300 dpi, the head causes perforations to be spaced apart too much in the direction F to allow the ink to sufficiently spread on a sheet, resulting in white stripes in the resulting image (see FIG. 20B).

Figure 20A:
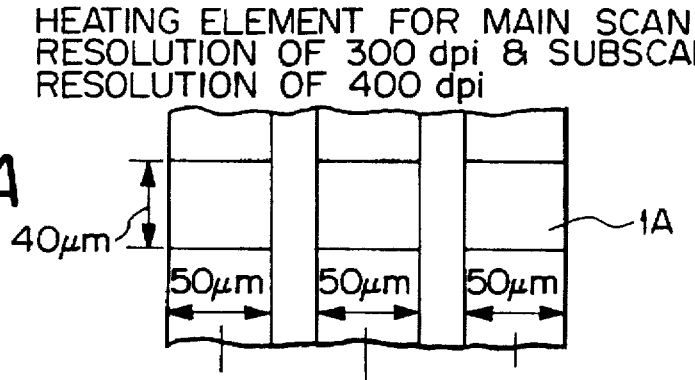
FIG. 20A shows other specific dimensions of the heating elements.
Figure 20B:
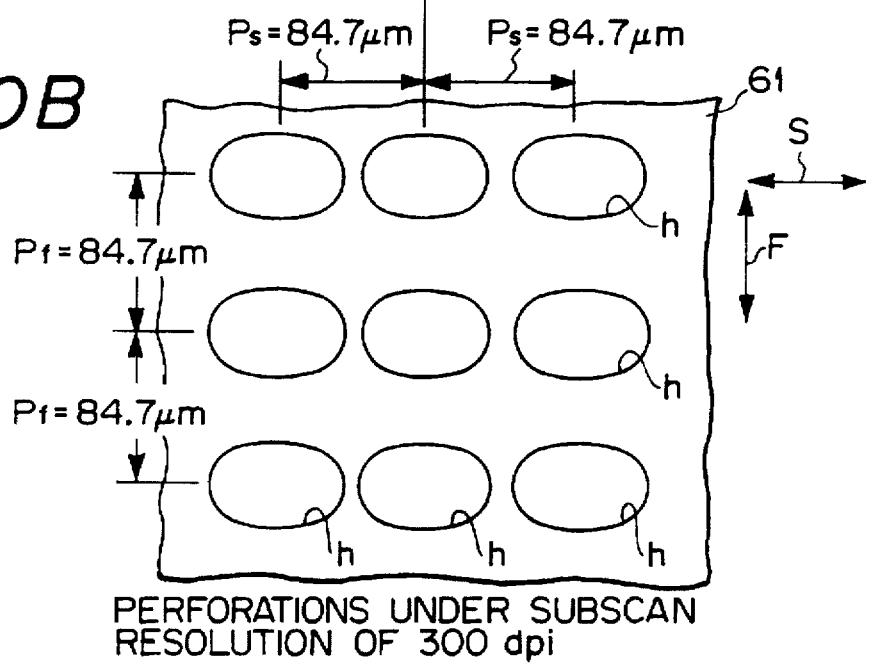
FIGS. 20B and 20C show perforations to be formed under the condition shown in FIG. 20A.
Figure 20C:
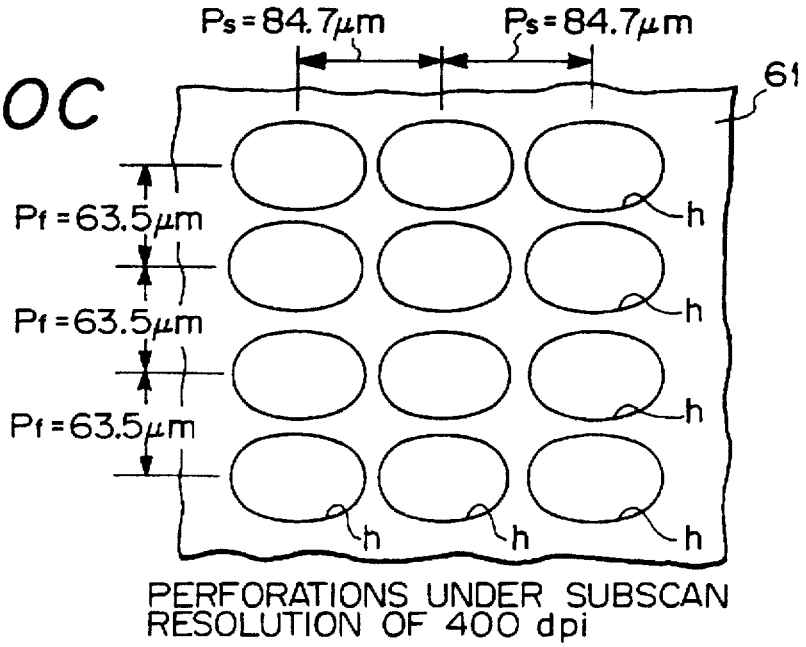

It is to be noted that the two consecutive pulse widths shown in FIGS. 14A and 14B are not necessary when priority is given to a short master making time available with the resolution of 300 dpi, although it would result in white stripes as shown in FIG. 20B, or when priority is given to the reduction of the amount of ink transfer to a sheet, i.e., the amount of ink consumption.

While two consecutive pulses are applied for a single image signal in FIGS. 14A, 14B and 15, the energy control means may be so constructed as to apply the energy three times or more for a single image signal, is desired. Again, this embodiment is also practicable with a stencil substantially implemented only by the thermoplastic resin film. For example, when a 1.6 μm thick stencil of this kind was perforated under the same conditions as in the embodiment, perforations were formed as discretely as in the embodiment and provided desired image quality matching a resolution in the subscanning direction. In addition, the transfer of ink from the underlying sheet to the the overlying sheet and fiber marks were obviated. Of course, the intermittent feed of the stencil in the direction F may be replaced with continuous feed, as needed.

In summary, the second embodiment has various advantages as enumerated below.

(1) When a desired resolution in the subscanning direction is selected on the resolution setting means, the energy control means controls the energy to be applied to each heating portion of the head in response to the output of the resolution setting means. The controlled energy allows perforations of optimal size in the subscanning direction to be formed in the stencil. Further, the heating portions are each sized less than the feed pitch corresponding to the highest resolution available with the resolution setting means. Hence, perforations of optimal size matching a desired resolution in the subscanning direction and discrete in both the main scanning direction and the subscanning direction are achieved without regard to the resolution. This produces an optimal image matching the desired resolution.

(2) The energy control means applies energy a plurality of times for a single image signal. This further insures the appropriate size of perforations in the subscanning direction and, therefore, desirable image quality.

(3) Since use is made of a stencil implemented substantially only by a thermoplastic resin film, the resulting image is free from fiber marks.

Various modifications will become possible for those skilled in the art after receiving the teachings of the present disclosure without departing from the scope thereof.

What is claimed is:

1. A thermosensitive stencil printer comprising:

a thermal head for perforating a thermosensitive stencil and having an array of heating portions arranged in a main scanning direction;

stencil conveying means for conveying the thermosensitive stencil in a sub scanning direction perpendicular to said main scanning direction;

a control device comprising, drive means for driving the stencil conveying means, resolution setting means for setting a selected resolution of an ink image in the sub scanning direction and for outputting a resolution signal corresponding to said selected resolution, drive control means for controlling, in response to said resolution signal, said drive means so as to drive said drive means at a pitch corresponding to the selected resolution of the ink image, and energy control means for controlling, in response to said resolution signal, energy to be applied to the heating portions of said thermal head so as to selectively generate heat in accordance with an image signal indicative of an original image;

means for pressing said thermal head against said thermosensitive stencil so that said selectively generated heat from said heating portions perforates said stencil in a pattern of perforations matching said image signal and at said selected resolution;

a print drum around which the stencil with the pattern of perforations is wrapped; and ink feeding means for forming said ink image on a sheet by feeding ink to said sheet via said stencil with the pattern of perforations.

2. The thermosensitive printer as claimed in claim 1, wherein said energy control means applies the energy a plurality of consecutive times for a single image signal.

3. The thermosensitive printer as claimed in claim 1, wherein said energy control means controls the energy by changing a pulse width of pulses to be applied to the heating portions.

4. The thermosensitive printer as claimed in claim 3, wherein said energy control means assigns a particular pulse width to each resolution in the subscanning direction.

5. The thermosensitive printer as claimed in claim 1, wherein said energy control means controls the energy by changing a current or a voltage to be applied to the heating portions in accordance with the image signal.

6. The thermosensitive printer as claimed in claim 1, wherein said resolution setting means allows the resolution to be changed stepwise in the subscanning direction.

7. The thermosensitive printer claimed in claim 1, wherein said resolution setting means allows the resolution to be continuously changed in the subscanning direction.

8. The thermosensitive printer as claimed in claim 1, wherein the heating portions each have a dimension in the subscanning direction which is 40% to 80% of the feed pitch matching the highest resolution available with said resolution setting means.

9. The thermosensitive stencil printer as claimed in claim 1, wherein said stencil conveying means conveys a thermosensitive stencil that comprises substantially only a thermoplastic resin.

* * * * *